US007215309B2

(12) United States Patent
Yamato et al.

(10) Patent No.: US 7,215,309 B2
(45) Date of Patent: May 8, 2007

(54) LIQUID CRYSTAL DISPLAY DEVICE AND METHOD FOR DRIVING THE SAME

(75) Inventors: Asahi Yamato, Tokyo (JP); Taketoshi Nakano, Kanagawa (JP); Toshihiro Yanagi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 588 days.

(21) Appl. No.: 10/803,997

(22) Filed: Mar. 19, 2004

(65) Prior Publication Data

US 2004/0183768 A1 Sep. 23, 2004

(30) Foreign Application Priority Data

Mar. 20, 2003 (JP) ..... 2003-078981

(51) Int. Cl.
*G09G 3/36* (2006.01)

(52) U.S. Cl. ..... 345/87; 345/98; 345/100

(58) Field of Classification Search ..... 345/87–90, 345/92–100, 209–211, 214; 349/37
See application file for complete search history.

(56) References Cited

U.S. PATENT DOCUMENTS

| | | | | |
|---|---|---|---|---|
| 6,184,855 | B1 * | 2/2001 | Kobayashi et al. | 345/100 |
| 2002/0063669 | A1 | 5/2002 | Yanagi et al. | |
| 2004/0196231 | A1 * | 10/2004 | Goto et al. | 345/87 |

FOREIGN PATENT DOCUMENTS

| | | | |
|---|---|---|---|
| CN | 1348166 | A | 8/2002 |
| JP | 05-303076 | | 11/1993 |
| JP | 08-320674 | | 12/1996 |
| JP | 8-320674 (A) | | 12/1996 |
| JP | H8-320674 | A | 12/1996 |
| JP | 2000-250496 | A | 9/2000 |

OTHER PUBLICATIONS

Korean Office Action issued on Dec. 15, 2005.

* cited by examiner

*Primary Examiner*—Richard Hjerpe
*Assistant Examiner*—Mansour M. Said
(74) *Attorney, Agent, or Firm*—Harness, Dickey & Pierce P.L.C.

(57) ABSTRACT

In a liquid crystal display device, a first skipping scanning process is performed by activating the scanning signals G(1), G(3) and G(5) corresponding to the odd-numbered rows in a pixel matrix made of numerous pixel formation portions in that order in a first half-period of a given frame, and voltages corresponding to the pixel values to be written into the pixel formation portions of the odd-numbered rows of the pixel matrix are applied to the video signal lines as positive-polarity video signals. In a second half-period of that frame, a second skipping scanning process is performed by activating the scanning signals G(2), G(4) and G(6) corresponding to the even-numbered rows in the pixel matrix in that order, and voltages corresponding to the pixel values to be written into the pixel formation portions of the even-numbered rows of the pixel matrix are applied to the video signal lines as negative-polarity video signals. Thus, line inversion driving is accomplished.

7 Claims, 15 Drawing Sheets

G(1)
G(2)
G(3)
G(4)
G(5)
G(6)

G(1)
G(2)
G(3)
G(4)
G(5)
G(6)

Fig. 11A
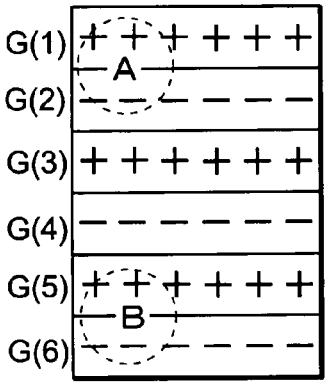
Fig. 11B
| SCREEN POSITION | A | B | A | B |
|---|---|---|---|---|
| LINE | ODD LINE | | EVEN LINE | |
| CONDITION | MEDIUM | WORST | BEST | MEDIUM |
Fig. 11C
| SCREEN POSITION | A | B | A | B |
|---|---|---|---|---|
| LINE | ODD LINE | | EVEN LINE | |
| CONDITION | MEDIUM | WORST | MEDIUM | BEST |
Fig. 12
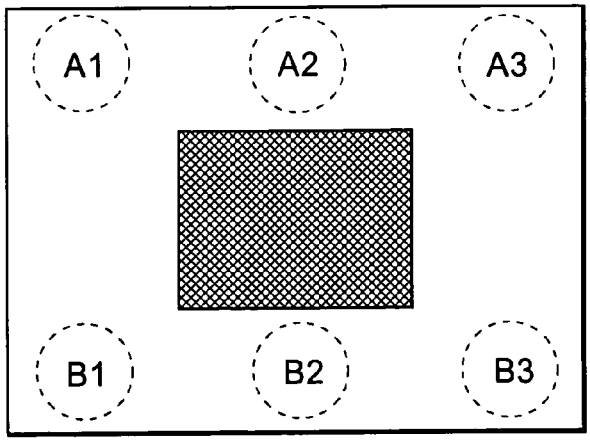

LIQUID CRYSTAL DISPLAY DEVICE AND METHOD FOR DRIVING THE SAME

CROSS REFERENCE TO RELATED APPLICATIONS

This application claims priority under 35 U.S.C. §119(a) upon Japanese Patent Application No. 2003-078981 titled "LIQUID CRYSTAL DISPLAY DEVICE AND METHOD FOR DRIVING THE SAME," filed on Mar. 20, 2003, the content of which is hereby incorporated by reference.

BACKGROUND OF THE INVENTION

1. Field of the Invention

The present invention relates to liquid crystal display devices and methods for driving the same. More specifically, the present invention relates to AC driving in active-matrix liquid crystal display devices.

2. Description of the Related Art

Ordinary liquid crystal display devices are driven by AC driving, in order to repress deterioration of the liquid crystal and to sustain the display quality. However, in active liquid crystal display devices, since the characteristics of switching elements, such as the TFTs (thin film transistors) provided for each pixel, are not sufficient, the transmittance of the liquid crystal layer does not become perfectly symmetric for positive and negative data voltages, even when the positive and negative portions of the video signals outputted from the video signal line driving circuit (also referred to as "column electrode driving circuit" or "data line driving circuit"), applying voltages to the video signal lines (column electrodes) of the liquid crystal panel, that is, the positive and negative portions of the applied voltage are symmetric with respect to the potential of the common electrode. Therefore, in driving schemes in which the polarity of the voltage applied to the liquid crystal is inverted at each frame (frame inversion driving scheme), flicker occurs in the display of the liquid crystal panel. Moreover, due to parasitic capacitances Csd (intra-pixel) and Csd (inter-pixel) that occur between video signal lines Lss, Lsn and pixel electrodes Ep, as shown in FIG. 9, each of the pixel values corresponding to the voltage between the pixel electrodes Ep and the common electrode Ec is affected by the potentials of the video signal lines Lss and Lsn, and a stripe-shaped pattern extending in vertical direction (also referred to as "vertical shadow") may appear on the screen.

In liquid crystal modules used for portable information appliances in which there is a particularly high need to reduce power consumption, such as portable phones, a frame inversion driving scheme has been employed as the AC driving scheme in order to meet this need. However, in recent years, also in portable phones, high-quality display capability has come to be demanded for portable phones due to improved processing performance and more sophisticated utilization, and accordingly, the problems of flicker and vertical shadows need to be addressed.

In order to solve these problems, a driving scheme inverting the polarity at each frame while inverting the polarity of the applied voltage at each horizontal scanning line (also called "line inversion driving scheme") is employed as an AC driving scheme. However, when the line inversion driving scheme is employed instead of the frame inversion driving scheme, then the frequency with which polarities of the video signals to be applied to the liquid crystal panel are inverted (i.e. the inversion frequency) becomes high, and also the switching frequency of the potential of the common electrode becomes high, due to the reduction of the necessary withstand voltage of the driving IC (integrated circuit). As a result, the power consumption becomes large. Moreover, it is not possible to sufficiently suppress flicker merely by employing the line inversion driving scheme.

SUMMARY OF THE INVENTION

It is thus an object of the present invention to present a liquid crystal display device with which the display quality can be improved by reducing flicker and shadows while responding to the strong need for lower power consumption in portable phones and the like.

According to one aspect of the present invention, an active-matrix liquid crystal display device comprises:

a plurality of pixel formation portions for forming an image to be displayed;

a plurality of video signal lines for transmitting a plurality of video signals representing the image to the plurality of pixel formation portions;

a plurality of scanning signal lines intersecting with the plurality of video signal lines, the plurality of pixel formation portions being arranged in a matrix, in correspondence to intersections of the plurality of video signal lines and the plurality of scanning signal lines;

a scanning signal line driving circuit for selectively driving the plurality of scanning signal lines; and a video signal line driving circuit for applying the plurality of video signals to the plurality of video signal lines;

wherein each of the pixel formation portions takes in, as a pixel value, the video signal applied by the video signal line driving circuit to the video signal line passing through the corresponding intersection when the scanning signal line passing through that corresponding intersection is selected by the scanning signal line driving circuit;

wherein the scanning signal line driving circuit alternates a first skipping scanning process in which the plurality of scanning signal lines are driven by selecting, in a predetermined order, scanning signal lines that are spaced apart by one or a predetermined number of scanning signal lines, and a second skipping scanning process in which the plurality of scanning signal lines are driven by selecting, in a predetermined order, those scanning signal lines that are not selected in the first skipping scanning process; and wherein the video signal line driving circuit applies to the plurality of video signal lines voltages of like polarity in the first skipping scanning process and voltages of like polarity in the second skipping scanning process as the plurality of video signals, and inverts the polarities of the voltages that are applied to the plurality of video signal lines when the driving of the scanning signal lines by the scanning signal line driving circuit switches from the first skipping scanning process to the second skipping scanning process.

With this configuration, the polarity of the voltages applied to the video signal lines in the first skipping scanning process is different from the polarity of the voltages applied to the video signal lines in the second skipping scanning process, but the voltages applied to the video signal lines in each of the skipping scanning processes have the same polarity, respectively, so that compared to the related art, it is possible to perform line inversion driving while greatly reducing the inversion frequency. Consequently, with this line inversion driving, it is possible to greatly reduce the power consumption while ensuring a favorable display quality (compared to frame inversion driving).

In this liquid crystal display device, it is preferable that the scanning signal line driving circuit selectively drives the plurality of scanning signal lines such that a scanning direction based on the order in which the scanning signal lines are selected in the first skipping scanning process is opposite to a scanning direction based on the order in which the scanning signal lines are selected in the second skipping scanning process.

With this configuration, the scanning directions in the first skipping scanning process and the second skipping scanning process are opposite to one another, so that the influence of voltage changes of the video signal lines on the pixel values (pixel voltages) held by the pixel formation portions is substantially cancelled out, reducing, as a result, the occurrence of luminance differences in the screen that are not related to the actual display content is reduced. That is to say, the occurrence of shadows is suppressed.

In this liquid crystal display device, it is preferable that the scanning signal line driving circuit puts the plurality of scanning signal lines into an unselected state for a predetermined period after the second skipping scanning process.

With this configuration, a scanning stop period is inserted, as the plurality of scanning signal lines are put into an unselected state for a predetermined period after the second skipping scanning process. By inserting such a scanning stop process, the proportion of periods in which flicker may occur is diminished, so that the occurrence of flicker is reduced. Moreover, by inserting such a scanning stop process, the proportion of periods in which luminance differences unrelated to the display content may occur is also diminished, so that also the occurrence of shadows is reduced.

In this liquid crystal display device, it is preferable that each of the pixel formation portions comprises:

a switching element that is turned on when a corresponding scanning signal line, which is the scanning signal line passing through the corresponding intersection, is selected, and that is turned off when that corresponding scanning signal line is not selected;

a pixel electrode that is connected via the switching element to the video signal line passing through the corresponding intersection; and a common electrode that is shared by the plurality of pixel formation portions, and that is arranged such that a predetermined capacitance is formed between that common electrode and the pixel electrode;

wherein simultaneously selected pixel electrodes, which are pixel electrodes that are connected to switching elements that are turned on and off by the same scanning signal line, are distributed over two vertically adjacent rows in the matrix made of the plurality of pixel formation portions.

With this configuration, the simultaneously selected pixel electrodes are distributed over two vertically adjacent rows in the matrix of the plurality of pixel formation portions, so that it is possible to realize pseudo-dot inversion driving while performing line inversion driving. Therefore, it is possible to reduce the occurrence of flicker while greatly reducing the power consumption compared to ordinary dot inversion driving.

According to another aspect of the present invention, a method for driving an active-matrix liquid crystal display device comprising a plurality of pixel formation portions for forming an image to be displayed; a plurality of video signal lines for transmitting a plurality of video signals representing the image to the plurality of pixel formation portions; and a plurality of scanning signal lines intersecting with the plurality of video signal lines, the plurality of pixel formation portions being arranged in a matrix, in correspondence to intersections of the plurality of video signal lines and the plurality of scanning signal lines;

comprises:

a scanning signal line driving step of selectively driving the plurality of scanning signal lines; and a video signal line driving step of applying the plurality of video signals to the plurality of video signal lines;

wherein, in the scanning signal line driving step, a first skipping scanning process in which the plurality of scanning signal lines are driven by selecting, in a predetermined order, scanning signal lines that are spaced apart by one or a predetermined number of scanning signal lines is performed in alternation with a second skipping scanning process in which the plurality of scanning signal lines are driven by selecting, in a predetermined order, those scanning signal lines that are not selected in the first skipping scanning process; and wherein, in the video signal line driving step, voltages of like polarity are applied to the plurality of video signal lines in the first skipping scanning process and voltages of like polarity are applied to the plurality of video signal lines in the second skipping scanning process as the plurality of video signals, and the polarities of the voltages that are applied to the plurality of video signal lines are inverted when the driving of the scanning signal lines in the scanning signal line driving step switches from the first skipping scanning process to the second skipping scanning process.

In this driving method, it is preferable that in the scanning signal line driving step, the plurality of scanning signal lines are driven selectively such that a scanning direction based on the order in which the scanning signal lines are selected in the first skipping scanning process is opposite to a scanning direction based on the order in which the scanning signal lines are selected in the second skipping scanning process.

In this driving method, it is also preferable that in the scanning signal line driving step, the plurality of scanning signal lines are put into an unselected state for a predetermined period after the second skipping scanning process.

These and other objects, features, aspects and advantages of the present invention will become more apparent from the following detailed description of the present invention when taken in conjunction with the accompanying drawings.

BRIEF DESCRIPTION OF THE DRAWINGS

FIG. 11A is a diagrammatic view illustrating the reduction of shadows with the second embodiment.

FIG. 11B shows the condition of pixels at various positions for the case that line inversion driving is always performed by a skipping scanning process in ascending order (first embodiment).

FIG. 11C shows the condition of pixels at various positions for the case that line inversion driving is performed by alternating a skipping scanning process in ascending order with a skipping scanning process in descending order (second embodiment).

FIG. 12 is a diagram showing a display example illustrating the reduction of shadows in the second embodiment.

DETAILED DESCRIPTION OF THE PREFERRED EMBODIMENTS

The following is a description of preferred embodiments of the invention, with reference to the accompanying drawings.

1. First Embodiment

1.1 Overall Configuration and Operation

Figure 1A:
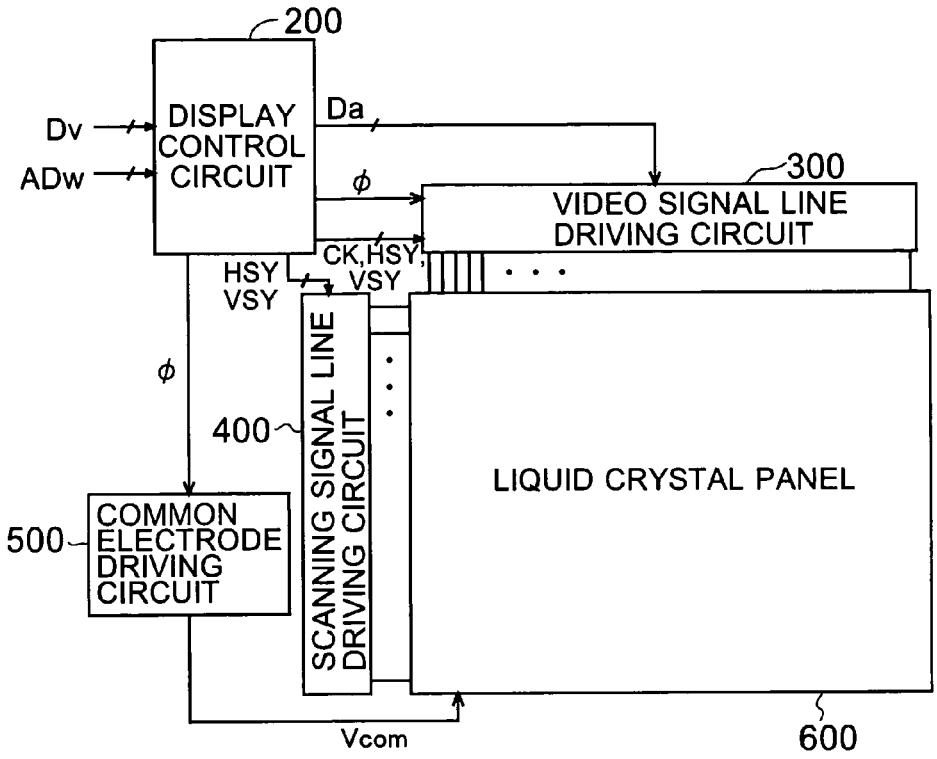
FIG. 1A is a block diagram showing the configuration of a liquid crystal display device according to a first embodiment of the present invention.

FIG. 1A is a block diagram showing the configuration of a liquid crystal display device according to a first embodiment of the present invention. This liquid crystal display device includes a display control circuit 200, a video signal line driving circuit 300 (also referred to as "column electrode driving circuit" or "data line driving circuit"), a scanning signal line driving circuit 400 (also referred to as "row electrode driving circuit" or "gate line driving circuit"), a common electrode driving circuit 500, and an active-matrix liquid crystal panel 600.

The liquid crystal panel 600 serving as the display portion in this liquid crystal display device comprises a plurality of scanning signal lines (row electrodes), which respectively correspond to the horizontal scanning lines in an image represented by image data Dv received from a CPU of an external computer or the like, a plurality of video signal lines (column electrodes) intersecting with the plurality of scanning signal lines, and a plurality of pixel formation portions that are provided in correspondence to the intersections of the plurality of scanning signal lines and the plurality of video signal lines. The configuration of these pixel formation portions is in principle the same as the configuration of the pixel formation portions in conventional active-matrix liquid crystal panels (details are discussed below). The liquid crystal panel 600 is further provided with a common electrode that is shared by the pixel electrodes included in the pixel formation portions and that is disposed in opposition to the pixel electrodes, sandwiching the liquid crystal layer.

In this embodiment, image data (in a narrow sense) representing an image to be displayed on the liquid crystal panel 600 and data determining the timing of the display operation (for example data indicating the frequency of the display clock) (referred to as "display control data" in the following) are sent from the CPU of the external computer or the like to the display control circuit 200 (in the following, the data Dv sent from the outside are referred to as "image data in a broad sense"). That is to say, the external CPU or the like supplies the image data (in the narrow sense) and the display control data, which constitute the image data Dv in a broad sense, as well as address signals ADw to the display control circuit 200, so that the image data (in the narrow sense) and the display control data are respectively written into a display memory and a register (described later) in the display control circuit 200.

Based on the display control data written into the register, the display control circuit 200 generates a display clock signal CK, a horizontal synchronization signal HSY, and a vertical synchronization signal VSY. Moreover, the display control circuit 200 reads out, from the display memory, the image data (in a narrow sense) that have been written into the display memory by the external CPU or the like, and outputs them as digital image signals Da. The display control circuit 200 also generates a polarity switching control signal $\phi$ for AC driving of the liquid crystal panel 600, based on the horizontal synchronization signal HSY and the vertical synchronization signal VSY. Thus, of the signals generated by the display control circuit 200, the clock signal CK is supplied to the video signal line driving circuit 300, the horizontal synchronization signal HSY and the vertical synchronization signal VSY are supplied to the video signal line driving circuit 300 and to the scanning signal line driving circuit 400, the digital image signals Da are supplied to the video signal line driving circuit 300, and the polarity switching control signal $\phi$ is supplied to the video signal line driving circuit 300 and the common electrode driving circuit 500.

As noted above, the data representing the image to be displayed on the liquid crystal panel 600 are supplied, pixel for pixel, as the digital image signals Da to the video signal line driving circuit 300, and the clock signal CK, the horizontal synchronization signal HSY, the vertical synchronization signal VSY, and the polarity switching control signal ϕ are supplied as the signals indicating the timing. Based on the signals Da, CK, HSY, VSY, and ϕ, the video signal line driving circuit 300 generates video signals D(1), D(2), D(3) . . . , for driving the liquid crystal panel 600 (referred to as "driving video signals" in the following), and applies these driving video signals D(1), D(2), D(3) . . . to the video signal lines of the liquid crystal panel 600. The polarity of these driving video signals D(1), D(2), D(3) . . . is inverted in accordance with the polarity switching control signal ϕ, in order to accomplish AC driving of the liquid crystal panel 600.

Based on the horizontal synchronization signal HSY and the vertical synchronization signal VSY, the scanning signal line driving circuit 400 generates scanning signals G(1), G(2), G(3) . . . to be applied to the scanning lines in order to select the scanning signal lines of the liquid crystal panel 600 for one horizontal scanning period each in a predetermined order that is described later. The application of the active scanning signal to the scanning signal lines for selecting all of the scanning signal lines in the predetermined order is carried out in repetition with a repeating period of one vertical scanning period.

The common electrode driving circuit 500 generates a common voltage Vcom, which is the voltage to be applied to the common electrode of the liquid crystal panel 600. In the present embodiment, also the potential of the common electrode is changed in accordance with the AC driving, in order to limit the amplitude of the voltage on the video signal lines. That is to say, in response to the polarity switching control signal ϕ from the display control circuit 200, the common electrode driving circuit 500 generates a voltage that is switched between two reference voltages in one frame (one vertical scanning period), and supplies this voltage as the common voltage Vcom to the liquid crystal panel 600.

In the liquid crystal panel 600, the video signal line driving circuit 300 applies the driving video signals D(1), D(2), D(3) . . . based on the digital image signals Da in the above-described manner to the video signal lines, the scanning signal line driving circuit 400 applies the scanning signals G(1), G(2), G(3) . . . to the scanning signal lines, and the common electrode driving circuit 500 applies the common voltage Vcom to the common electrode. Thus, the liquid crystal panel 600 displays the image represented by the image data Dv received from the external CPU or the like.

1.2 Display Control Circuit

Figure 1B:
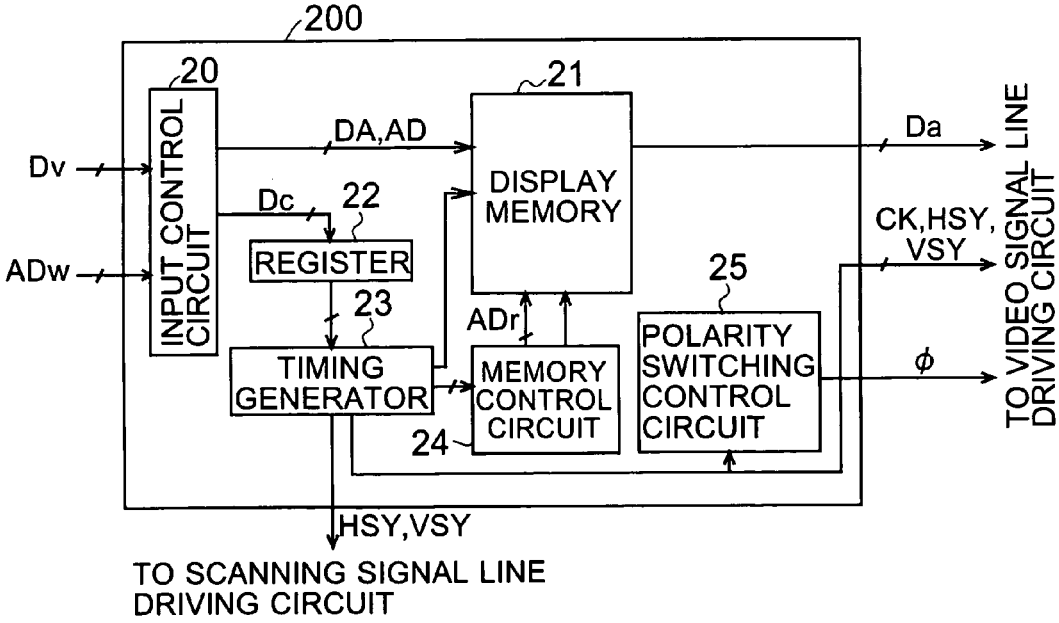
FIG. 1B is a block diagram showing the configuration of a display control circuit in the liquid crystal display device according to the first embodiment.

FIG. 1B is a block diagram showing the configuration of the display control circuit 200 in the above-described liquid crystal display device. This display control circuit 200 includes an input control circuit 20, a display memory 21, a register 22, a timing generator 23, a memory control circuit 24, and a polarity switching control circuit 25.

Address signals ADw and signals representing image data Dv in a broad sense (in the following, also these signals are denoted as "Dv") that this display control circuit 200 receives from the external CPU or the like are inputted into the input control circuit 20. Based on the address signals ADw, the input control circuit 20 divides the image data Dv in a broad sense into image data DA and display control data Dc. Then, signals representing the image data DA (in the following, also these signals are denoted as "DA") are supplied to the display memory 21 together with address signals AD based on the address signals ADw, so that the image data DA are written into the display memory 21, and the display control data Dc are written into the register 22. The display control data Dc comprise timing information that specifies the frequency of the clock signal CK and the horizontal scanning period and the vertical scanning period for displaying the image represented by the image data Dv.

Based on the display control data held in the register 22, the timing generator 23 generates the clock signal CK, the horizontal synchronization signal HSY and the vertical synchronization signal VSY. Moreover, the timing generator 23 generates a timing signal for operating the display memory 21 and the memory control circuit 24 in synchronization with the clock signal CK.

The memory control circuit 24 generates address signals ADr for reading out, of the image data DA that are inputted from outside and stored in the display memory 21 via the input control circuit 20, the data representing the image to be displayed on the liquid crystal panel 600. The memory control circuit 24 also generates a signal for controlling the operation of the display memory 21. The address signals ADr and the control signal are given to the display memory 21, and thus, the data representing the image to be displayed on the liquid crystal panel 600 are read out as the digital image signals Da from the display memory 21, and are outputted from the display control circuit 200. As mentioned above, the digital image signals Da are supplied to the video signal line driving circuit 300.

Based on the horizontal synchronization signal HSY and the vertical synchronization signal VSY generated by the timing generator 23, the polarity switching control circuit 25 generates the polarity switching control signal ϕ. This polarity switching control signal ϕ, which is a control signal determining the timing of the polarity inversions for AC driving of the liquid crystal panel 600, is supplied to the video signal line driving circuit 300 and the common electrode driving circuit 500, as mentioned above.

1.3 Liquid Crystal Panel

Figure 2A:
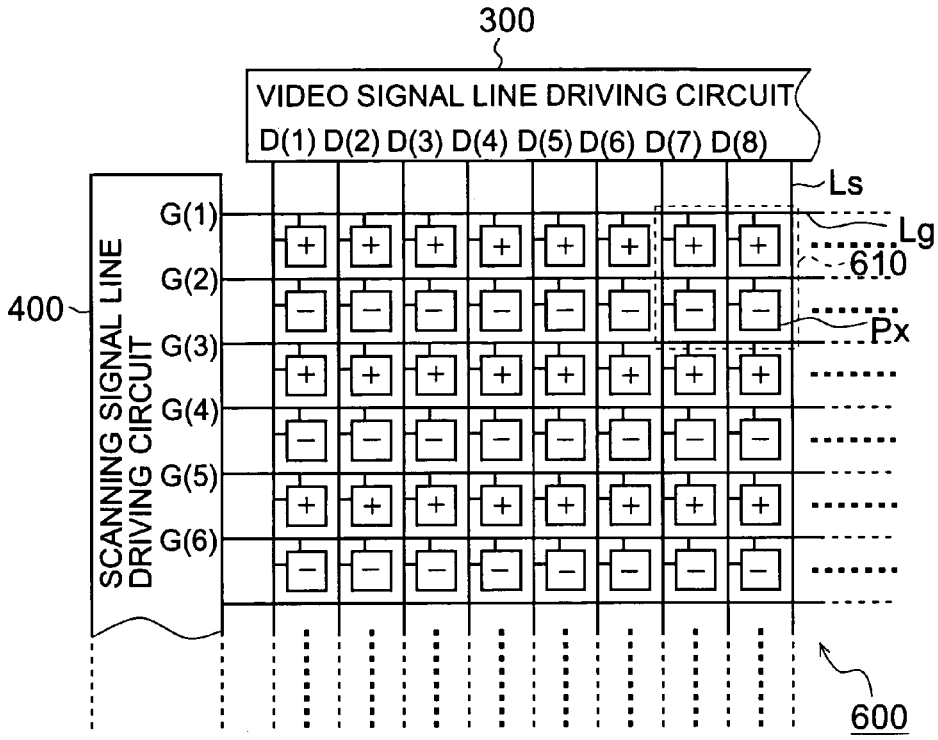
FIG. 2A is a diagrammatic view showing the configuration of a liquid crystal panel in the first embodiment.
Figure 2B:
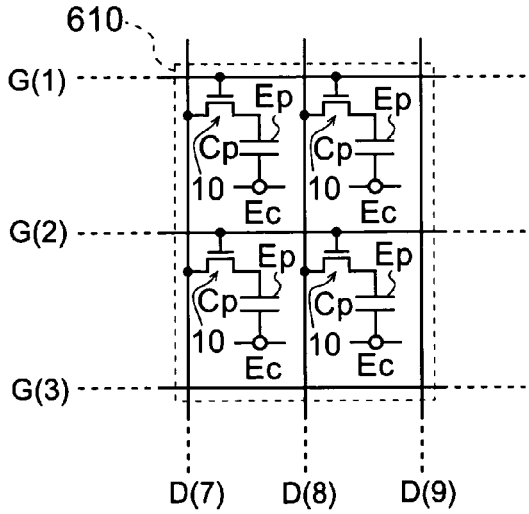
FIG. 2B is an equivalent circuit diagram of a portion (corresponding to four pixels) of the liquid crystal panel in the first embodiment.

FIG. 2A is a diagrammatic view showing the configuration of the liquid crystal panel 600 according to the present embodiment. FIG. 2B is an equivalent circuit diagram of a portion 610 (corresponding to four pixels) of this liquid crystal panel.

The liquid crystal panel 600 includes a plurality of video signal lines Ls that are connected to the video signal line driving circuit 300, and a plurality of scanning signal lines Lg that are connected to the scanning signal line driving circuit 400. The video signal lines Ls and the scanning signal lines Lg are arranged in a lattice pattern, so that the video signal lines Ls intersect with the scanning signal lines Lg. As noted above, a plurality of pixel formation portions Px are provided in a one-to-one correspondence with the intersections of the video signal lines Ls and the scanning signal lines Lg.

As shown in FIG. 2B, each of the pixel formation portions Px is made of a TFT 10 whose source terminal is connected to the video signal line Ls passing through the corresponding intersection and whose gate terminal is connected to the scanning signal line Lg passing through the corresponding intersection, a pixel electrode Ep connected to the drain terminal of that TFT 10, a common electrode Ec (also referred to as "opposing electrode") that is shared by the plurality of pixel formation portions Px, and a liquid crystal layer that is shared by the plurality of pixel formation portions Px and sandwiched between the pixel electrode Ep and the common electrode Ec. The pixel electrode Ep, the common electrode Ec and the liquid crystal layer sandwiched between them form a pixel capacitance Cp. This configuration of the pixel formation portion Px is the same for the embodiments of the present invention described below.

As can be seen from this configuration, when the scanning signal G(k) applied to any of the scanning signal lines Lg becomes active, then that scanning signal line is selected, the TFTs 10 (of the pixel formation portions Px) connected to this scanning signal line become conductive, and driving video signals D(j) are applied via the video signal lines Ls to the pixel electrodes Ep connected to the TFTs 10. Thus, the voltages (with respect to the potential of the common electrode Ec) of the applied driving video signals D(j) are written as the pixel values into the pixel formation portions Px including those pixel electrodes Ep.

The pixel formation portions Px are arranged in a matrix, constituting a pixel formation matrix, and accordingly, also the pixel electrodes Ep included in the pixel formation portions Px are arranged in a matrix, constituting a pixel electrode matrix. The pixel electrodes Ep, which are the principal portions of the pixel formation portions Px, are in a one-to-one correspondence with the pixels of the image displayed on the liquid crystal panel, and can be regarded as identical therewith. Henceforth, to keep the description simple, the pixel formation portions Px and the pixel electrodes Ep are regarded as the same as the pixels, and the "pixel formation matrix" and the "pixel electrode matrix" are also referred to as the "pixel matrix."

In FIG. 2A, the "+" marking some of the pixel formation portions Px means that a positive voltage is applied in a given frame to the pixel liquid crystal constituting those pixel formation portions Px (or, taking the common electrode Ec as reference potential, to the pixel electrodes Ep) and the "−" marking some of the pixel formation portions Px means that a negative voltage is applied in that frame to the pixel liquid crystal constituting those pixel formation portions Px (or, taking the opposing electrode Ec as reference potential, to the pixel electrodes Ep). The "+" and "−" marking the pixel formation portions Px represent a polarity pattern in the pixel matrix. The method for expressing such a polarity pattern is also the same for all other embodiments of the present invention, described below. It should be noted that, as shown in FIG. 2A, this embodiment employs a line inversion driving scheme, which is a driving scheme in which the polarities of the voltages applied to the pixel liquid crystal are inverted at each line of the pixel matrix and also at each frame.

1.4 Driving Method

Referring to FIGS. 3A to 3F and 4, the following is a description of a method for driving the liquid crystal display device according to the present embodiment, which is provided with the liquid crystal panel 600 of the above-described configuration. To simplify the following explanations, the number of scanning signal lines Lg of the liquid crystal panel 600 is assumed to be six, the number of video signal lines Ls is also assumed to be six, the scanning signal line driving circuit 400 applies one of the scanning signals G(1) to G(6) to each of the six scanning signal lines Lg, and the video signal line driving circuit 300 applies one of the driving video signals D(1) to D(6) to each of the six video signal lines Ls.

FIGS. 3A to 3F are diagrams illustrating a method for driving a liquid crystal display device according to the present embodiment. The rectangles made of six rows in FIGS. 3A to 3F represent a pixel matrix, and the "+" and "−" signs marking the pixel matrix indicate the polarities of the voltages applied to the pixel liquid crystal, that is, the voltages of the pixel electrodes Ep with respect to the common electrode Ec (referred to as "pixel voltages" in the following). The arrows drawn along the rectangles representing the pixel matrix indicate the scanning direction (that is, whether scanning is performed in ascending order or descending order of the row numbers). FIG. 4 is a timing chart illustrating this driving method. That is to say, FIGS. 4-(*a*) to 4-(*f*) show the scanning signals G(1) to G(6). When a scanning signal G(k) (with k=1 . . . 6) is at H level (high level), then the scanning signal line Lg to which this scanning signal G(k) is applied is selected, and when a scanning signal G(k) is at L level (low level), then the scanning signal line Lg to which this scanning signal G(k) is applied takes on an unselected state. FIG. 4-(*g*) shows, for each horizontal scanning period Th, the voltage polarity (with respect to the common electrode Ec) of the driving video signals D(1) to D(6) applied to the video signal lines Ls.

Figures 3A, 3B, 3C, 3D, 3E, 3F:
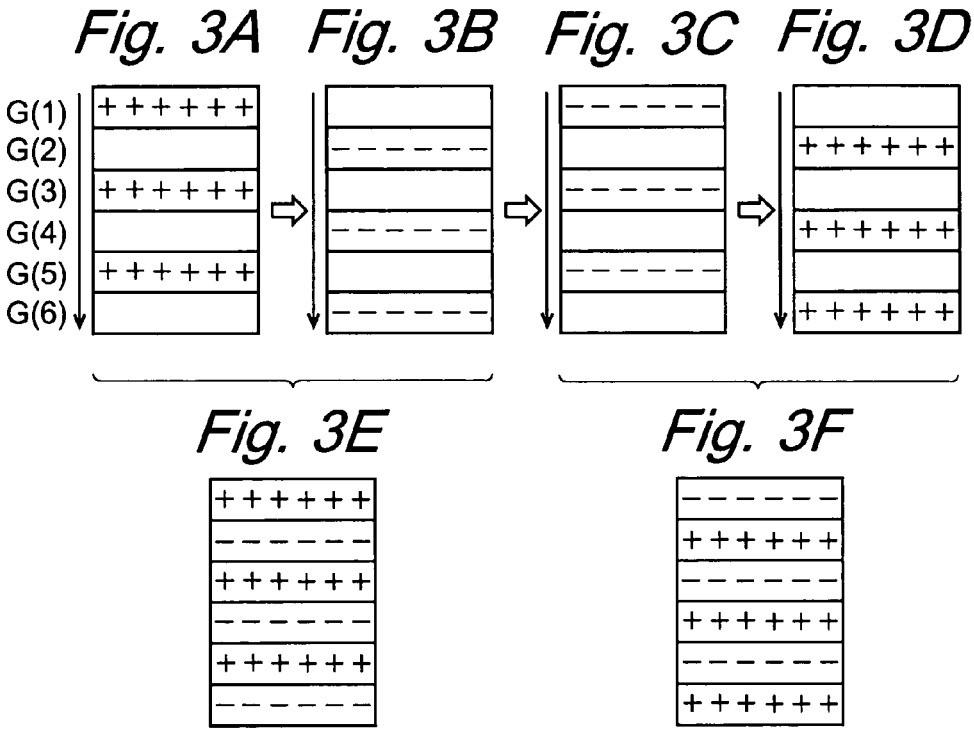
FIGS. 3A to 3F are diagrams illustrating a method for driving a liquid crystal display device according to the first embodiment.
Figure 4:
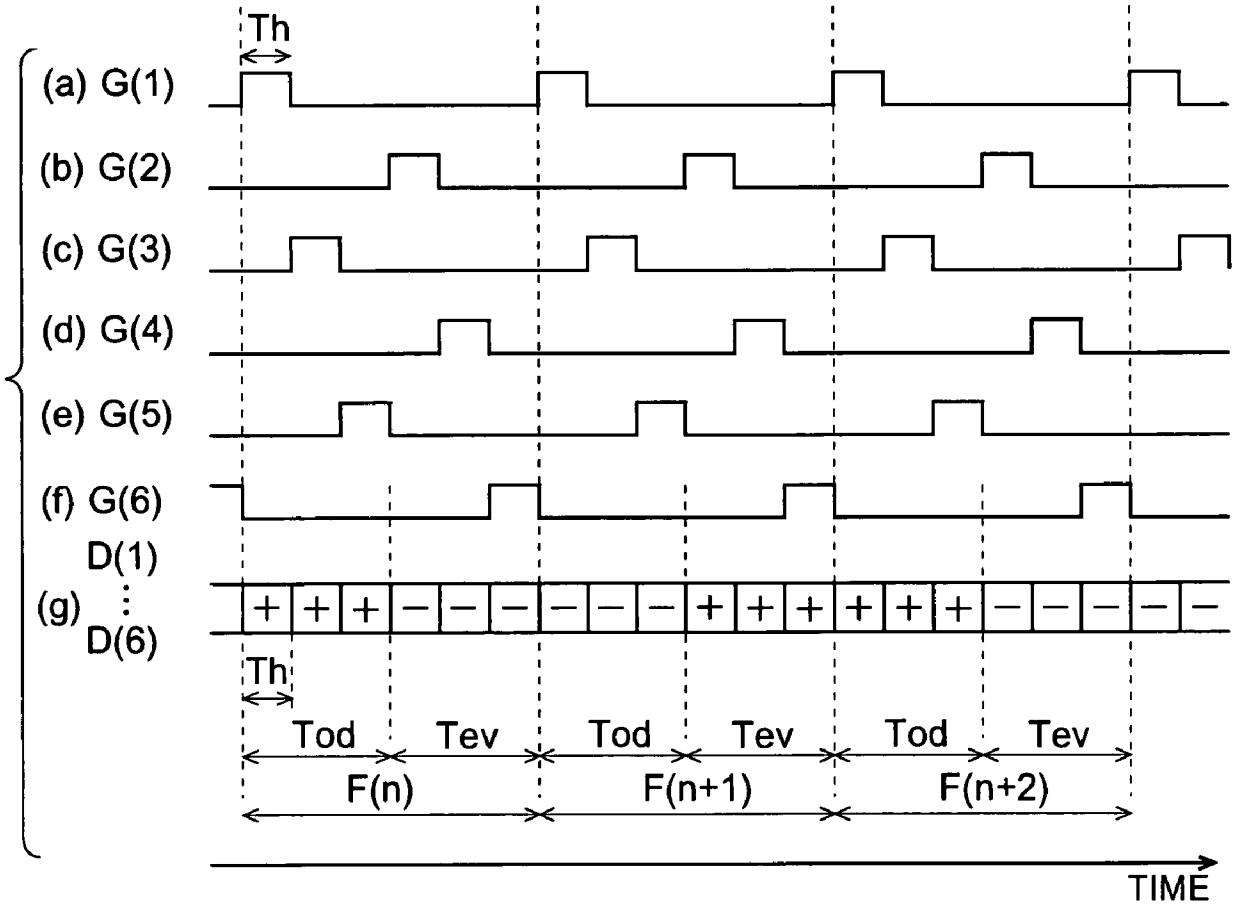
FIG. 4 is a timing chart illustrating the method for driving the liquid crystal display device according to the first embodiment.

FIG. 3A shows the polarities of the pixel voltages corresponding to the pixel values that are rewritten by the video signals D(1) to D(6) in the first half-period of a given frame (in the following, this frame is considered to be the n-th frame, expressed as "F(n)"). In this driving method, as shown in FIGS. 4-(*a*) to 4-(*f*), in the first half-period Tod of the n-th frame F(n), the scanning signals G(1), G(3) and G(5), which correspond to the odd-numbered rows of the pixel matrix become active in this order, in other words the odd-numbered scanning lines Lg are selected in ascending order, thereby performing a skipping scanning process (in the following, this scanning process is referred to as "first skipping scanning process", and the period Tod of this scanning process is referred to as "odd field"). Then, the voltages corresponding to the pixel values to be written into the pixel formation portions Px in the first, third and fifth row of the pixel matrix are applied to the video signal lines Ls in the active period of the scanning signals G(1), G(3) and G(5), respectively, as positive-polarity video signals D(1) to D(6), as shown in FIG. 4-(*g*). It should be noted that in this odd field Tod, the even-numbered scanning signals G(2), G(4) and G(6) are inactive, so that the pixel voltages applied before this odd field Tod are maintained as the pixel values in the pixel formation portions Px of the even-numbered rows in the pixel matrix. In order to illustrate this, neither of the polarity indicating symbols "+" and "−" is marked in the even-numbered rows of the pixel matrix in FIG. 3A. This method for expressing the polarities is also the same in the other embodiments.

FIG. 3B shows the polarities of the pixel voltages corresponding to the pixel values that are rewritten by the video signals D(1) to D(6) in the second half-period of the n-th frame. In this driving method, as shown in FIGS. 4-(*a*) to 4-(*f*), in the second half-period Tev of the n-th frame F(n), the scanning signals G(2), G(4) and G(6), which correspond to the even-numbered rows of the pixel matrix become active in this order, in other words the even-numbered scanning lines Lg are selected in ascending order, thereby performing a skipping scanning process (in the following, this scanning process is referred to as "second skipping scanning process"), and the period Tev of this scanning process is referred to as "even field"). Then, the voltages corresponding to the pixel values to be written into the pixel formation portions Px in the second, fourth and sixth row of the pixel matrix are applied to the video signal lines Ls in the active period of the scanning signals G(2), G(4) and G(6), respectively, as negative-polarity video signals D(1) to D(6), as shown in FIG. 4-(*g*). It should be noted that in the even field Tev, the odd-numbered scanning signals G(1), G(3) and G(5) are inactive, so that the pixel voltages applied before this even field Tev (that is, in the period of the odd field Tod of the n-th frame F(n)) are maintained as the pixel values in the pixel formation portions Px of the odd-numbered rows in the pixel matrix.

FIG. 3C shows the polarities of the pixel voltages corresponding to the pixel values that are rewritten by the video signals D(1) to D(6) in the first half-period of the (n+1)th frame. In this driving method, in the odd field Tod, which is the first half-period of the (n+1)th frame F(n+1), the scanning signals G(1), G(3) and G(5), which correspond to the odd-numbered rows of the pixel matrix, become active in this order, thereby performing a first skipping scanning process (FIGS. 4-(*a*) to 4-(*f*)), and the voltages corresponding to the pixel values to be written into the pixel formation portions Px in the first, third and fifth row of the pixel matrix are applied to the video signal lines Ls as negative-polarity video signals D(1) to D(6) (FIG. 4-(*g*)). It should be noted that in this odd field Tod, the even-numbered scanning signals G(2), G(4) and G(6) are inactive, so that the pixel voltages applied before this odd field Tod (that is, in the period of the even field Tev of the n-th frame F(n)) are maintained as the pixel values in the pixel formation portions Px of the even-numbered rows in the pixel matrix.

FIG. 3D shows the polarities of the pixel voltages corresponding to the pixel values that are rewritten by the video signals D(1) to D(6) in the second half-period of the (n+1)th frame. In this driving method, in the even field Tev, which is the second half-period of the (n+1)th frame F(n+1), the scanning signals G(2), G(4) and G(6), which correspond to the even-numbered rows of the pixel matrix, become active in this order, thereby performing a second skipping scanning process (FIGS. 4-(*a*) to 4-(*f*)), and the voltages corresponding to the pixel values to be written into the pixel formation portions Px in the second, fourth and sixth row of the pixel matrix are applied to the video signal lines Ls as positive-polarity video signals D(1) to D(6) (FIG. 4-(*g*)). It should be noted that in this even field Tev, the odd-numbered scanning signals G(1), G(3) and G(5) are inactive, so that the pixel voltages applied before this even field Tev (that is, in the period of the odd field Tod of the (n+1)th frame F(n+1)) are maintained as the pixel values in the pixel formation portions Px of the odd-numbered rows in the pixel matrix.

With this driving method, the polarity pattern of the pixel matrix becomes as shown in FIG. 3E at the time when the n-th frame F(n) finishes, and becomes as shown in FIG. 3F at the time when the (n+1)th frame F(n+1) finishes. Thus, with this driving method, it is possible to perform line inversion driving.

1.5 Advantageous Effect

In the present embodiment, line inversion driving is performed in the manner described above, and compared to conventional line inversion driving, it is possible to greatly reduce the power consumption. In the following, this is explained with reference to FIGS. 5 and 6.

Figure 5:
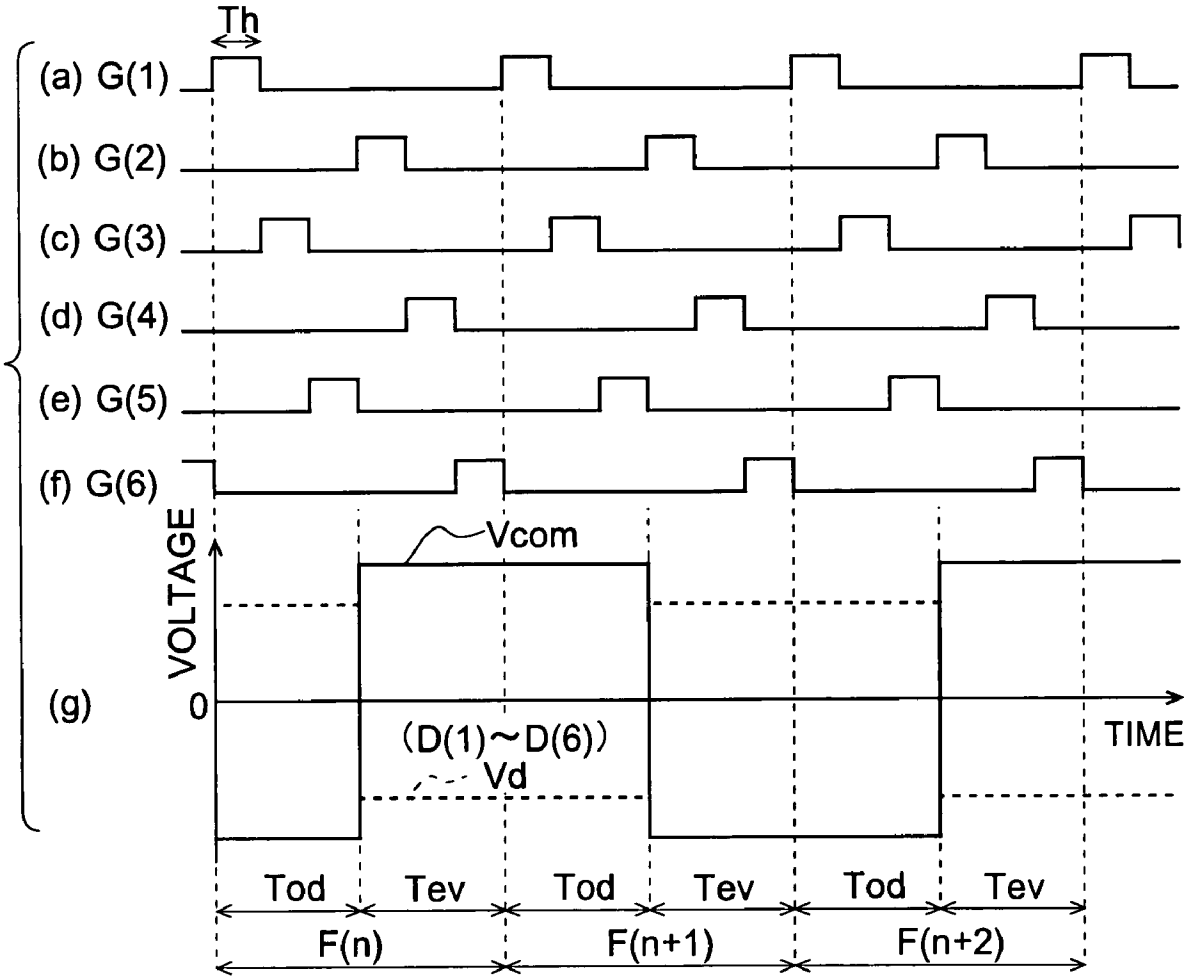
FIG. 5 is a voltage waveform chart illustrating the reduction of the power consumption according to the first embodiment.
Figure 6:
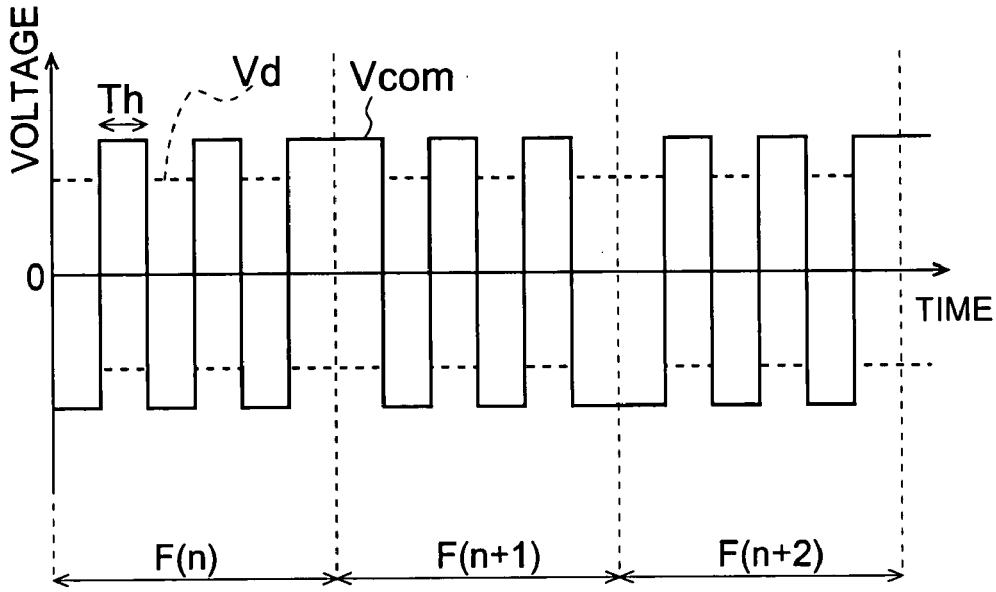
FIG. 6 is a voltage waveform chart illustrating the power consumption of a conventional liquid crystal display device employing a line inversion driving scheme.

FIG. 5 shows the waveforms of the voltages of the video signals D(1) to D(6) applied to the video signal lines Ls in the present embodiment (in the following referred to as "video signal voltage", and denoted as "Vd" when there is no need to make a distinction among the voltage values of the video signal lines Ls), and the common voltage Vcom applied to the common electrode Ec, together with the waveform of the scanning signals G(1) to G(6). FIG. 6 shows the waveforms of the video signal voltage Vd and the common voltage Vcom in a conventional liquid crystal display device (referred to as "conventional example" below) employing a line inversion driving scheme. Comparing FIG. 5 with FIG. 6, it can be seen that in the present embodiment, when the number of scanning lines is Y, the inversion frequency becomes 1/(Y−1) of that of the conventional example (in the examples shown in FIGS. 5 and 6, Y=6, so that the inversion frequency is ⅕ of that of the conventional example). Ordinarily, the power consumption for driving the liquid crystal panel is proportional to the inversion frequency. Consequently, with the present embodiment, the power consumption for driving the liquid crystal panel is about 1/(Y−1) of that of the conventional example.

Thus, with the present embodiment, with the line inversion driving as shown in FIGS. 3A to 3F and 4, it is possible to considerably decrease the power consumption compared to that of conventional line inversion driving, while keeping flicker lower than in frame inversion driving.

It should be noted that the present embodiment is premised on line inversion driving in which the polarity of the pixel voltage is inverted line by line in the pixel matrix, and only the odd-numbered lines are scanned in the first half-period of each frame, whereas only the even-numbered lines are scanned in the second half-period of each frame. That is to say, in order to reduce the inversion frequency, a skipping scanning process is performed in which every other scanning signal line Lg is selected. However, with a configuration in which each frame period is divided into a period in which the lines to which a positive voltage is to be applied are scanned in a skipping manner and a period in which the lines to which a negative voltage is to be applied are scanned in a skipping manner, that is, a configuration in which the lines to which a voltage of the same polarity is to be applied within the same frame are consecutively scanned, it is also possible to perform a skipping scanning process in which a plurality of scanning signal lines Lg are skipped over at each selection. For example, for 2-line inversion driving in which the polarity of the pixel voltage is inverted line pair by line pair in the pixel matrix, it is also possible to perform a first skipping scanning process by selecting, in the first half-period of each frame, pairs of two of the scanning signal lines Lg, while skipping over two scanning lines, and to perform a second skipping scanning process by selecting, in the second half-period of each frame, pairs of two of the scanning signal lines Lg that are not selected in the first half-period of that frame. With this configuration, the inversion frequency can be diminished considerably, so that also the power consumption is reduced considerably.

2. Second Embodiment

The following is an explanation of a liquid crystal display device according to a second embodiment of the present invention. This embodiment differs from the first embodiment in that this embodiment employs the driving method shown in FIGS. 7A to 7F and 8 instead of the driving method shown in FIGS. 3A to 3F and 4. The overall configuration and the configuration of the liquid crystal panel in this embodiment are similar to the first embodiment, so that identical or corresponding portions are denoted by the same reference numerals, and their further description has been omitted.

2.1 Driving Method

Referring to FIGS. 7A to 7F and 8, the following is a description of a method for driving a liquid crystal display device according to the present embodiment. Also in the present embodiment, to simplify the following explanations, the number of scanning signal lines Lg of the liquid crystal panel 600 is assumed to be six, the number of video signal lines Ls is also assumed to be six, the scanning signal line driving circuit 400 applies one of the scanning signals G(1) to G(6) to each of the six scanning signal lines Lg, and the video signal line driving circuit 300 applies one of the driving video signals D(1) to D(6) to each of the six video signal lines Ls.

FIGS. 7A to 7F are diagrams illustrating a method for driving a liquid crystal display device according to the present embodiment, and the notation method of these figures is the same as that used in FIGS. 3A to 3F. Moreover, FIG. 8 is a timing chart illustrating this driving method, and the notation method of this chart is the same as that used in FIG. 4.

Figures 7A, 7B, 7C, 7D, 7E, 7F:
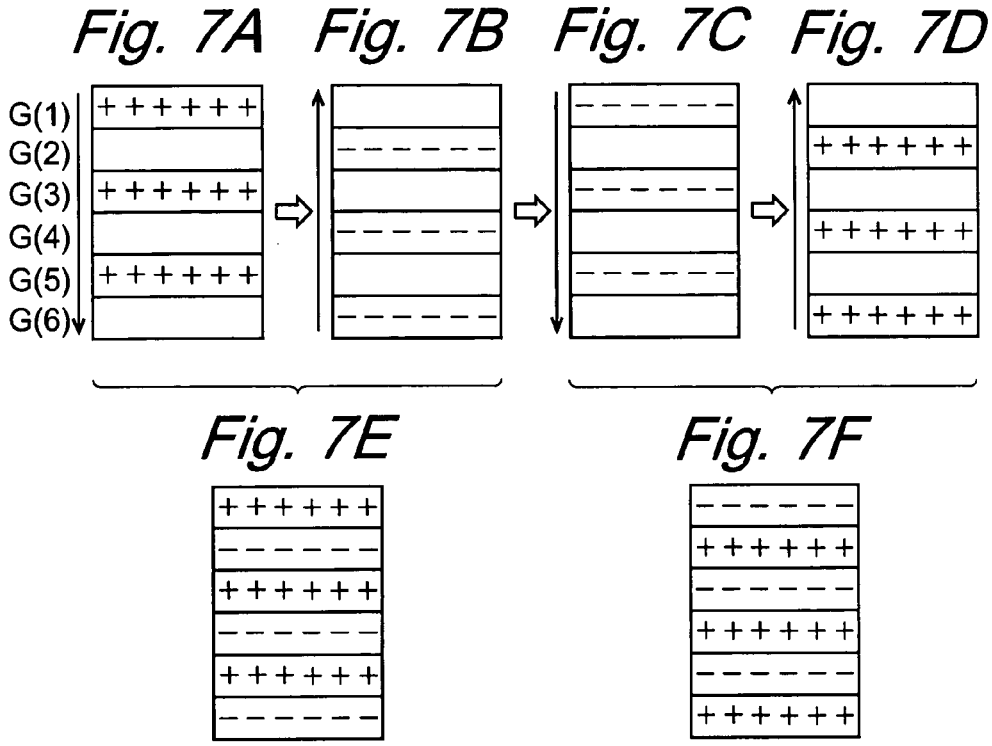
FIGS. 7A to 7F are diagrams illustrating a method for driving a liquid crystal display device according to a second embodiment of the present invention.
Figure 8:
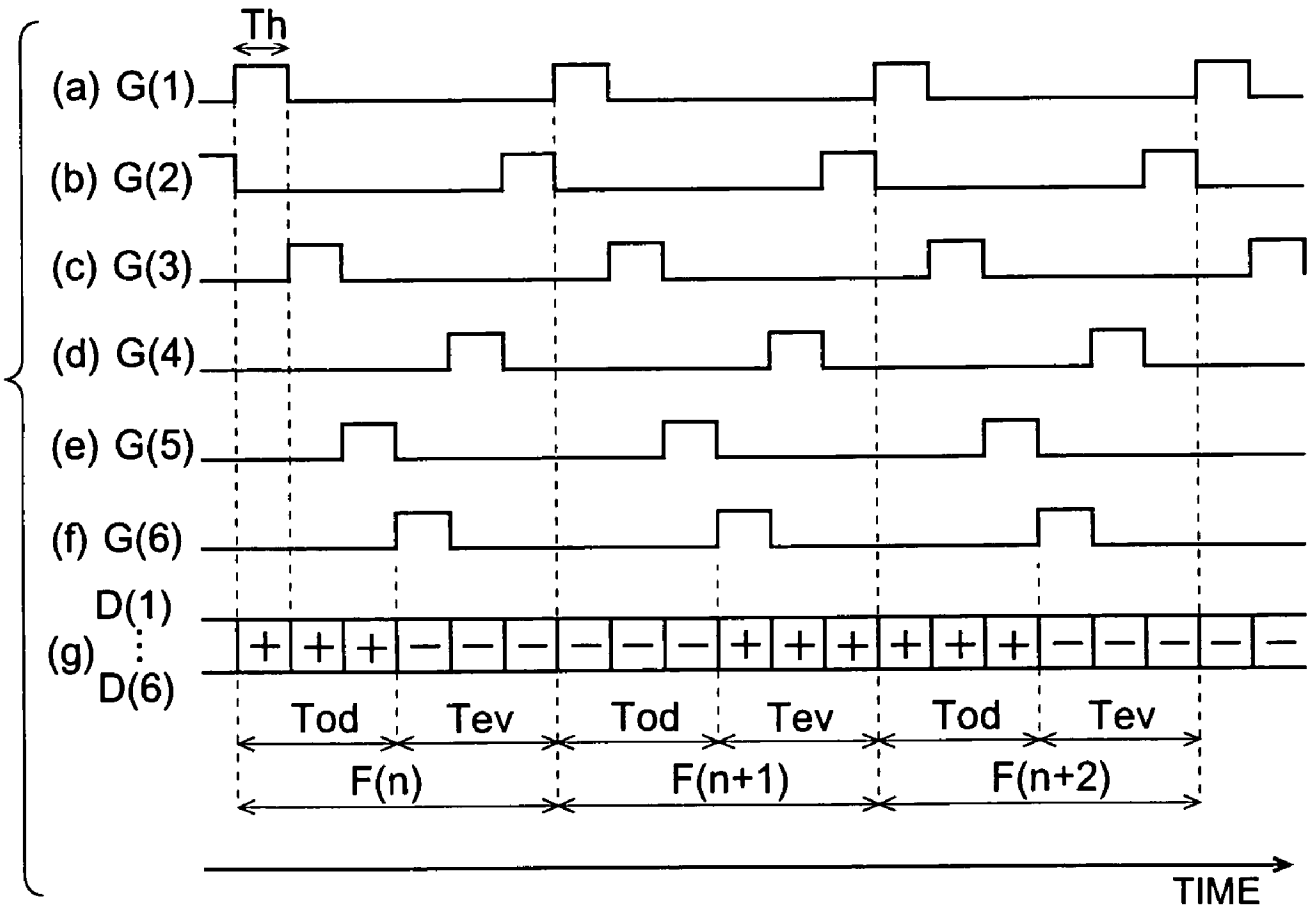
FIG. 8 is a timing chart illustrating the method for driving a liquid crystal display device according to the second embodiment.

FIG. 7A shows the polarities of the pixel voltages corresponding to the pixel values that are rewritten by the video signals D(1) to D(6) in the first half-period of the n-th frame. In this driving method, as shown in FIGS. 8-(*a*) to 8-(*f*), in the odd field Tod, which is the first half-period of the n-th frame F(n), the scanning signals G(1), G(3) and G(5), which correspond to the odd-numbered rows of the pixel matrix, become active in this order, in other words the odd-numbered scanning lines Lg are selected in ascending order, thereby performing a first skipping scanning process. Then, the voltages corresponding to the pixel values to be written into the pixel formation portions Px in the first, third and fifth row of the pixel matrix are applied to the video signal lines Ls in the active period of the scanning signals G(1), G(3) and G(5), respectively, as positive-polarity video signals D(1) to D(6) as shown in FIG. 8-(*g*). It should be noted that in the odd field Tod, the even-numbered scanning signals G(2), G(4) and G(6) are inactive, so that the pixel voltages applied before this odd field Tod are maintained as the pixel values in the pixel formation portions Px of the even-numbered rows in the pixel matrix.

FIG. 7B shows the polarities of the pixel voltages corresponding to the pixel values that are rewritten by the video signals D(1) to D(6) in the second half-period of the n-th frame. In this driving method, as shown in FIGS. 8-(*a*) to 8-(*f*), in the second half-period Tev of the n-th frame F(n), the scanning signals G(2), G(4) and G(6), which correspond to the even-numbered rows of the pixel matrix, become active in the reverse order, in other words the even-numbered scanning lines Lg are selected in descending order, thereby performing a second skipping scanning process. Then, the voltages corresponding to the pixel values to be written into the pixel formation portions Px in the sixth, fourth and second row of the pixel matrix are applied to the video signal lines Ls in the active period of the scanning signals G(6), G(4) and G(2), respectively, as negative-polarity video signals D(1) to D(6) as shown in FIG. 8-(*g*). Here, the upward-pointing arrow in FIG. 7B indicates that the second skipping scanning process in the even field Tev is carried out in the direction opposite to that in the conventional example and in the first embodiment. It should be noted that in the even field Tev, the odd-numbered scanning signals G(1), G(3) and G(5) are inactive, so that the pixel voltages applied before this even field Tev (that is, in the period of the odd field Tod of the n-th frame F(n)) are maintained as the pixel values in the pixel formation portions Px of the odd-numbered rows in the pixel matrix.

FIG. 7C shows the polarities of the pixel voltages corresponding to the pixel values that are rewritten by the video signals D(1) to D(6) in the first half-period of the (n+1)th frame that follows. In this driving method, in the odd field Tod, which is the first half-period of the (n+1)th frame F(n+1), the scanning signals G(1), G(3) and G(5), which correspond to the odd-numbered rows of the pixel matrix, become active in that order, thereby performing a first skipping scanning process (see FIGS. 8-(*a*) to 8-(*f*)). The voltages corresponding to the pixel values to be written into the pixel formation portions Px in the first, third and fifth row of the pixel matrix are applied to the video signal lines Ls as negative-polarity video signals D(1) to D(6) (see FIG. 8-(*g*)). It should be noted that in the odd field Tod, the even-numbered scanning signals G(2), G(4) and G(6) are inactive, so that the pixel voltages applied before this odd field Tod (that is, in the period of the even field Tev of the n-th frame F(n)) are maintained as the pixel values in the pixel formation portions Px of the even-numbered rows in the pixel matrix.

FIG. 7D shows the polarities of the pixel voltages corresponding to the pixel values that are rewritten by the video signals D(1) to D(6) in the second half-period of the (n+1)th frame that follows. In this driving method, in the even field Tev, which is the second half-period of the (n+1)th frame F(n+1), the scanning signals G(2), G(4) and G(6), which correspond to the even-numbered rows of the pixel matrix, become active in the reverse order, thereby performing a second skipping scanning process (see FIGS. 8-(*a*) to 8-(*f*)). The voltages corresponding to the pixel values to be written into the pixel formation portions Px in the sixth, fourth and second row of the pixel matrix are applied to the video signal lines Ls as positive-polarity video signals D(1) to D(6) (see FIG. 8-(*g*)) in the active period of these scanning signals G(6), G(4) and G(2). It should be noted that in the even field Tev, the odd-numbered scanning signals G(1), G(3) and G(5) are inactive, so that the pixel voltages applied before this even field Tev (that is, in the period of the odd field Tod of the (n+1)th frame F(n+1)) are maintained as the pixel values in the pixel formation portions Px of the odd-numbered rows in the pixel matrix.

With this driving method, the polarity pattern of the pixel matrix becomes as shown in FIG. 7E at the time when the n-th frame F(n) finishes, and becomes as shown in FIG. 7F at the time when the (n+1)th frame F(n+1) finishes. Thus, with this driving method, it is possible to perform line inversion driving, like in the first embodiment.

2.2 Operation and Advantageous Effect

With the present embodiment as described above, line inversion driving can be performed while greatly reducing the inversion frequency, like in the first embodiment, so that the same effect of reducing the power consumption as in the first embodiment can be attained.

Moreover, in the present embodiment, as shown in FIGS. 7A to 7D, the direction of the first skipping scanning process is opposite to the direction of the second skipping scanning process. That is to say, the scanning signals G(1) to G(6) are applied to the scanning signal lines Lg in such a manner that a skipping scanning process in ascending order and a skipping scanning process in descending order are carried out in alternation (FIGS. 8-(*a*) to 8-(*f*)). Thus, the occurrence of shadows can be suppressed. This is explained in the following with reference to FIGS. 9 to 12.

Figure 9:
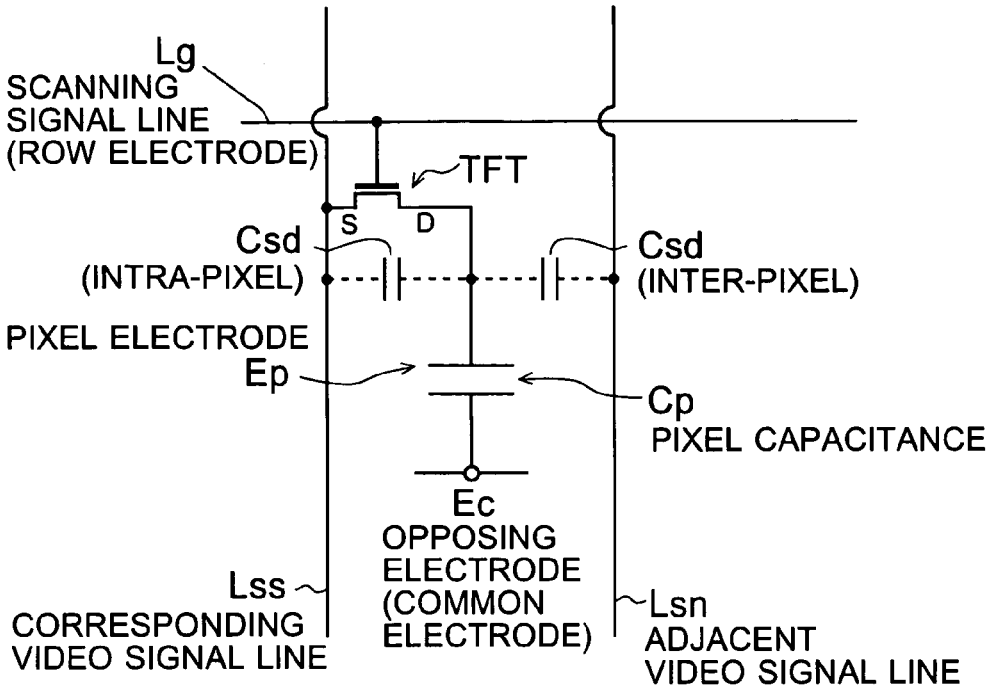
FIG. 9 is an equivalent circuit diagram showing the configuration of a pixel formation portion Px in a liquid crystal panel.

FIG. 9 is an equivalent circuit diagram of a pixel formation portion Px in an active-matrix liquid crystal display device according to the present invention. As shown in this figure, Lss is the one of the two video signal Ls sandwiching the pixel electrode Ep that is for writing data into the pixel formation portion (more precisely, into the pixel capacitance Cp), and Lsn (referred to as "adjacent video signal line" in the following) is the other one of those two video signal lines Ls. There is a parasitic capacitance (referred to as "Csd (intra-pixel)" in the following) between the corresponding video signal line Lss and the pixel electrode Ep, and there is a parasitic capacitance (referred to as "Csd (inter-pixel)" in the following) between the other video signal line Lsn and the pixel electrode Ep. Therefore, after the pixel values have been written into the pixel formation portions Px forming the pixels (that is, when the TFTs are off), the pixel voltages corresponding to the pixel values are influenced by potential changes (changes in the video signal voltage Vd) of the corresponding video signal line Lss via the Csd (intra-pixel) and potential changes (changes in the video signal voltage Vd) of the adjacent video signal line Lsn via the Csd (inter-pixel). "Shadows" such as vertical shadow or the like may occur in the form of a display that is not included in the actual display content, due to the influence stemming from changes of the video signal voltage Vd in the corresponding video signal line Lss and the adjacent video signal line Lsn.

Figure 10:
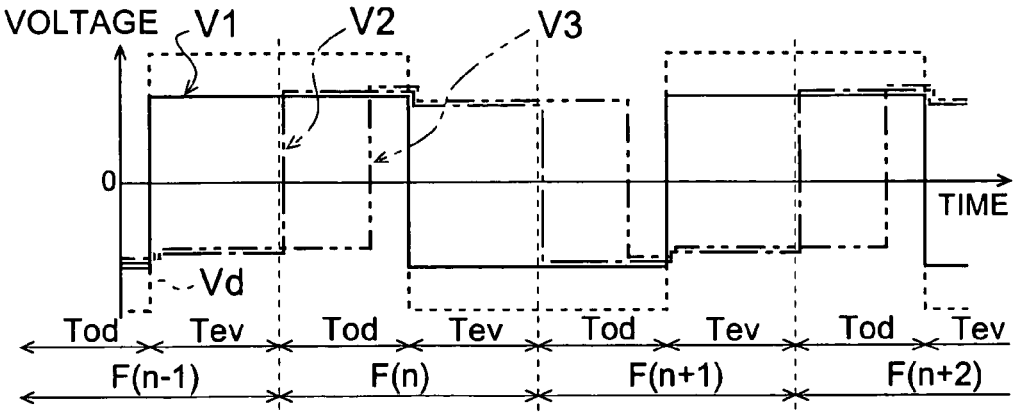
FIG. 10 shows a voltage waveform illustrating the reduction of shadows with the second embodiment.

FIG. 10 is a voltage waveform diagram illustrating the reduction of shadows due to the influence of changes in the video signal voltage Vd acting via the parasitic capacitances Csd (intra-pixel) and Csd (inter-pixel). In this figure, the (bold) dotted line marks the video signal voltage Vd (here, to simplify explanations, the voltage of all video signal lines is denoted as the same value Vd), and the solid line, the dot-dash line and the dot-dot-dash line illustrate the voltages applied to the pixel electrodes at different positions on the screen (referred to, for convenience, as "pixel voltages" in the following). The pixel voltage V1 marked by the solid line changes at substantially the same timing as the video signal voltage Vd, the pixel voltage V2 marked by the dash-dot line changes at an offset of ¼ period with respect to the change of the video signal voltage Vd, and the pixel voltage V3 marked by the dash-dash-dot line changes at an offset of about ½ period with respect to the change of the video signal voltage Vd.

The influence of the changes of the video signal voltage Vd on the pixel voltage V1, which is given as a solid line, is smallest among the three pixel voltages V1, V2 and V3, and the influence of the changes of the video signal voltage Vd on the pixel voltage V3, which is given as a dot-dot-dash line, are largest. The influence of the changes of the video signal voltage Vd on the pixel voltage V2, which is given as a dot-dash line, is in between the influences on the pixel voltage V1 and the pixel voltage V3. Consequently, seen from the viewpoint of shadow reduction, the pixels corresponding to the pixel voltage V1 can be thought of being in "best condition", the pixels corresponding to the pixel voltage V2 can be thought of being in "medium condition", and the pixels corresponding to the pixel voltage V3 can be thought of being in "worst condition." It should be noted that in general, if the scanning direction is fixed as in the first embodiment, then there is a difference between the effective values of the pixel voltages for the rows of the pixel matrix that are scanned close to the scanning start time and rows of the pixel matrix that are scanned close to the scanning end time, even if the content to be displayed by those rows is the same and thus, luminance differences between the pixels of those two types of rows may occur. This luminance difference is what is meant by the generation of shadows.

In FIGS. 11A to 11C, the conditions for the pixels in the upper portion A of the screen and the conditions for the pixels in the lower portion B of the screen are organized in view of lowering this shadow. FIG. 11B shows the condition of the pixels at the various positions for the case that line inversion driving is always performed by a skipping scanning process in ascending order as in the first embodiment, and FIG. 11C shows the condition of the pixels at the various positions for the case that line inversion driving is performed by alternating a skipping scanning process in ascending order with a skipping scanning process in descending order as in the present embodiment.

If the scanning is always performed in ascending order as in the first embodiment, then, as shown in FIG. 11B, the pixels of the odd lines at the upper portion A of the screen are in medium condition and the pixels of the even lines at the upper portion A of the screen are in best condition, whereas the pixels of the odd lines at the lower portion B of the screen are in worst condition and the pixels of the even lines at the lower portion B of the screen are in medium condition. Consequently, in this case, the condition at the lower portion B of the screen is worse than at the upper portion A of the screen, so that the lower portion B of the screen is susceptible to changes in the video signal voltage Vd and prone to shadows. Moreover, if a filled out rectangle is displayed in the middle of the screen, as shown in FIG. 12, then the shadow tends to be conspicuous. That is to say, in the case of the display shown in FIG. 12, a shadow occurs due to the above-described effect in the lower portions B1 and B3 on the left and the right side of the screen, but the occurrence of a shadow in the portion B2 below the rectangle is suppressed by the display of the rectangle. As a result, the luminance difference between the upper portion A1 and the lower portion B1 on the left side of the screen and the luminance difference between the upper portion A3 and the lower portion B3 on the right side of the screen become easy to perceive as shadows for the human eye.

On the other hand, if scanning is performed by repeating in alternation a skipping scanning process in ascending order and a skipping scanning process in descending order (in the following referred to as "direction inversion scanning process") as in the present embodiment, then, as shown in FIG. 11C, the pixels in the odd lines and the pixels in the even lines at the upper portion A of the screen are both in medium condition, whereas the pixels in the odd lines at the lower portion B of the screen are in worst condition and the pixels in the even lines at the lower portion B of the screen are in best condition. Consequently, in this case, the worst condition and the best condition at the lower portion B of the screen cancel each other out, and as a result, the condition at the lower portion B of the screen is substantially the same as the condition at the upper portion A of the screen. Consequently, if a direction inversion scanning process is performed as in the present embodiment, then the generation of shadows is suppressed.

Thus, with the present embodiment, it is possible to suppress the generation of shadows, while attaining a similar advantageous effect as in the first embodiment.

3. Third Embodiment

The following is an explanation of a liquid crystal display device according to a third embodiment of the present invention. This embodiment differs from the first embodiment in that this embodiment employs the driving method shown in FIG. 13 instead of the driving method shown in FIG. 4. The overall configuration and the configuration of the liquid crystal panel in this embodiment are similar to the first embodiment, so that identical or corresponding portions are denoted by the same reference numerals, and their further description has been omitted. It should be noted that the polarity pattern of the pixel matrix in the present embodiment, like that in the first embodiment, changes as shown in FIGS. 3A to 3D in accordance with the driving of the liquid crystal panel 600, but there is a (later-described)

scanning stop period while changing from the polarity pattern in FIG. 3B to the polarity pattern in FIG. 3C, and this aspect is different from the first embodiment.

3.1 Driving Method

Referring to FIGS. 3A to 3F and 13, the following is a description of a method for driving a liquid crystal display device according to the present embodiment. Also in the present embodiment, to simplify the following explanations, the number of scanning signal lines Lg of the liquid crystal panel 600 is assumed to be six, the number of video signal lines Ls is also assumed to be six, the scanning signal line driving circuit 400 applies one of the scanning signals G(1) to G(6) to each of the six scanning signal lines Lg, and the video signal line driving circuit 300 applies one of the driving video signals D(1) to D(6) to each of the six video signal lines Ls.

Figure 13:
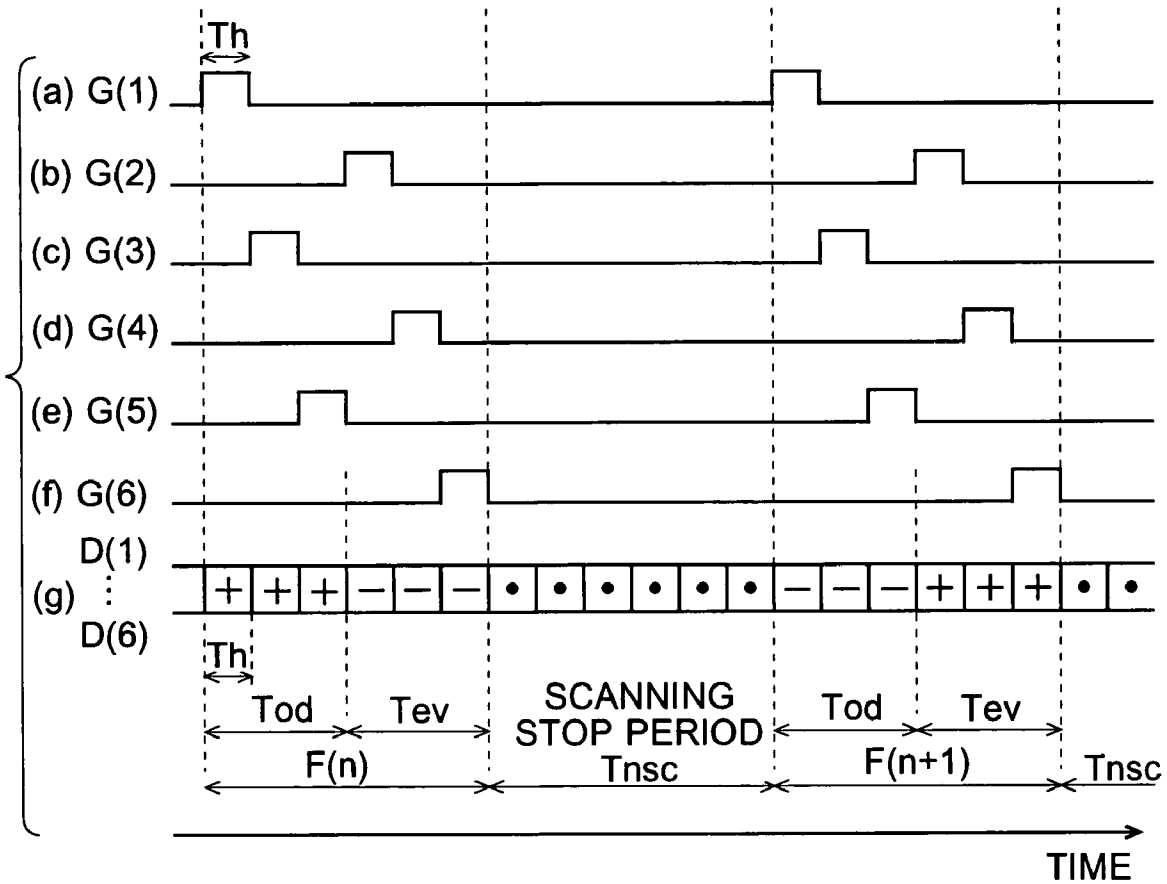
FIG. 13 is a timing chart illustrating the method for driving a liquid crystal display device according to a third embodiment of the present invention.

In the present embodiment, the same scanning signals G(1) to G(6) and video signals D(1) to D(6) as in the n-th frame F(n) of the first embodiment are applied in the n-th frame F(n) to (the scanning signal lines Lg and the video signal lines Ls of) the liquid crystal panel 600, as shown in FIGS. 13-(*a*) to 13-(*g*), and driving is performed in the same manner as in the n-th frame F(n) in the first embodiment. That is to say, in the n-th frame F(n), inversion driving is performed as shown in FIGS. 3A and 3B, and when the n-th frame F(n) ends, the polarity pattern of the pixel matrix is as shown in FIG. 3E.

In the present embodiment, as shown in FIGS. 13-(*a*) to 13-(*f*), after the n-th frame F(n) ends, all scanning signals G(1) to G(6) become inactive for a predetermined period Tnsc (for example a period of one frame) and scanning is stopped. In this scanning stop period Tnsc, the polarity pattern of the pixel matrix stays in the state of the pattern shown in FIG. 3E.

When this scanning stop period Tnsc ends, the (n+1)th frame F(n+1) of the present embodiment starts. At the (n+1)th frame F(n+1), the same scanning signals G(1) to G(6) and video signals D(1) to D(6) as in the (n+1)th frame F(n+1) of the first embodiment are applied to the liquid crystal panel 600, as shown in FIG. 13-(*a*) to 13-(*g*), and driving is performed in the same manner as in the (n+1)th frame F(n+1) in the first embodiment. That is to say, in the (n+1)th frame F(n+1), inversion driving is performed as shown in FIGS. 3C and 3D, and when the (n+1)th frame F(n+1) ends, the polarity pattern of the pixel matrix is as shown in FIG. 3F.

When this (n+1)th frame F(n+1) ends, a scanning stop period Tnsc similar to the one described above is inserted before advancing to the (n+2)th frame F(n+2). At the scanning stop period Tnsc, the polarity pattern of the pixel matrix stays the same as the pattern shown in FIG. 3F.

Thus, in the present embodiment, a scanning stop period Tnsc is inserted every time a frame ends. That is to say, a first skipping scanning process is performed, in which video signals D(1) to D(6) of the same polarity are applied, then a second skipping scanning process is performed, in which video signals D(1) to D(6) of different polarity than in the first skipping scanning process are applied, and after that, the scanning is stopped for a predetermined period Tnsc, after which the next frame starts. It should be noted that there is no particular limitation to the voltage levels of the video signals D(1) to D(6) in the scanning stop period Tnsc. For example, it is possible to sustain the voltages immediately before the scanning stop period Tnsc, to set voltage values that change at an appropriate period, or to set the output terminals of the video signals D(1) to D(6) of the video signal line driving circuit 300 to a high-impedance state.

3.2 Operation and Advantageous Effect

With the present embodiment as described above, in addition to similar advantageous effects as in the first embodiment, it is possible to reduce the occurrence of flicker and shadows by inserting the scanning stop line Tnsc. This is explained in the following.

3.2.1 Reduction of Flicker

Figure 14A:
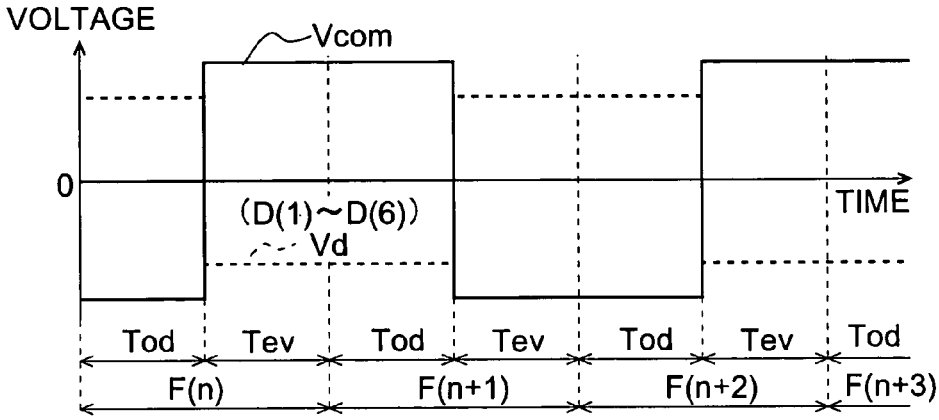
FIG. 14A shows the waveform of the video signal voltage and the common voltage in the first embodiment.

FIG. 14A shows the waveform of the video signal voltage Vd and the common voltage Vcom in the first embodiment. In the first embodiment, in each of the frames, those rows of the pixel matrix to which a pixel voltage of the same polarity is to be applied are scanned continuously, so that immediately before the polarity inversion of the video signal voltage Vd and the common voltage Vcom, all pixel voltages of the pixel matrix have the same polarity. That is to say, in the example shown in FIG. 14A, immediately before switching from the odd field Tod to the even field Tev in the n-th frame F(n) (immediately before advancing from the first skipping scanning process to the second skipping scanning process), all pixel voltages of the pixel matrix are positive, and immediately before switching from the odd field Tod to the even field Tev in the (n+1)th frame F(n+1), all pixel voltages of the pixel matrix are negative. Thus, periods in which substantially all pixel voltages in the pixel matrix have the same polarity appear repeatedly, which leads to the occurrence of flicker.

Figure 14B:
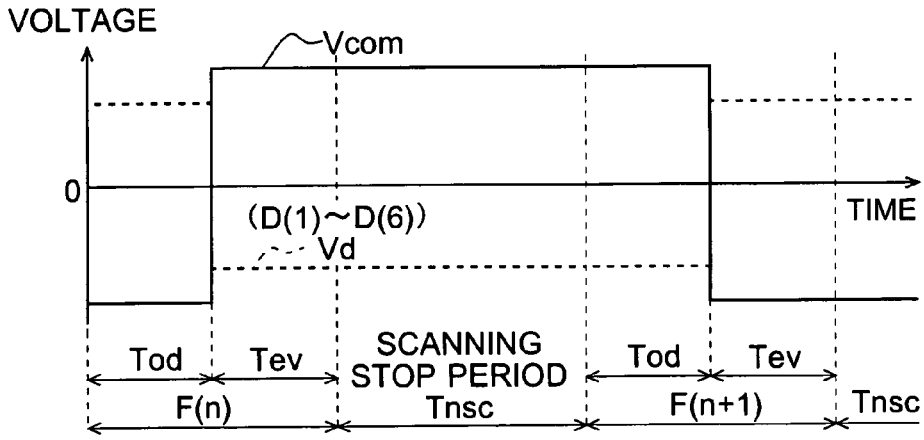
FIG. 14B shows the waveform of the video signal voltage and the common voltage in the third embodiment.

In the present embodiment, on the other hand, the video signal voltage Vd and the common voltage Vcom are as shown in FIG. 14B, and in the scanning stop period Tnsc, a state is assumed in which the polarities of the pixel voltages differ at each row of the pixel matrix, that is, a state in which pixel formation portions with different pixel voltage polarities are distributed evenly over the pixel matrix. In the example shown in FIG. 14B, in the scanning stop period Tnsc after the n-th frame F(n), the polarity pattern of the pixel matrix stays in the state of the patterns shown in FIG. 3E. As a result, even though with the present embodiment a period is repeated in which substantially all pixel voltages in the pixel matrix have the same polarity, periods of a state in which pixel formation portions with different pixel voltage polarities are distributed evenly over the pixel matrix are inserted as the scanning stop period Tnsc, thus reducing the proportion taken up by periods in which flicker may occur. Thus, flicker is reduced in comparison to the first embodiment.

3.2.2 Reduction of Shadows

Figure 15A:
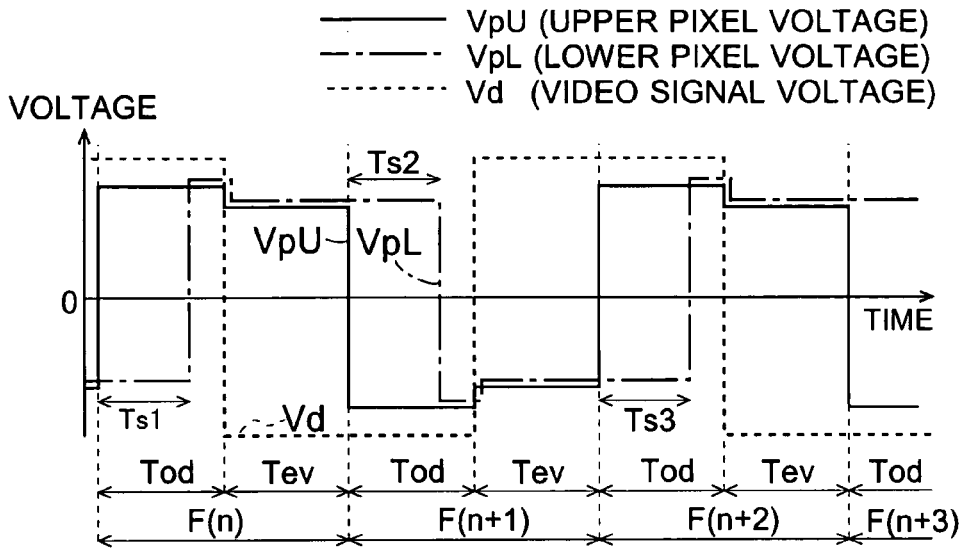
FIG. 15A shows the waveforms of the video signal voltage as well as the voltages applied to the pixel electrodes in the upper and lower screen portions (upper pixel voltage and lower pixel voltage) in the first embodiment.
Figure 15B:
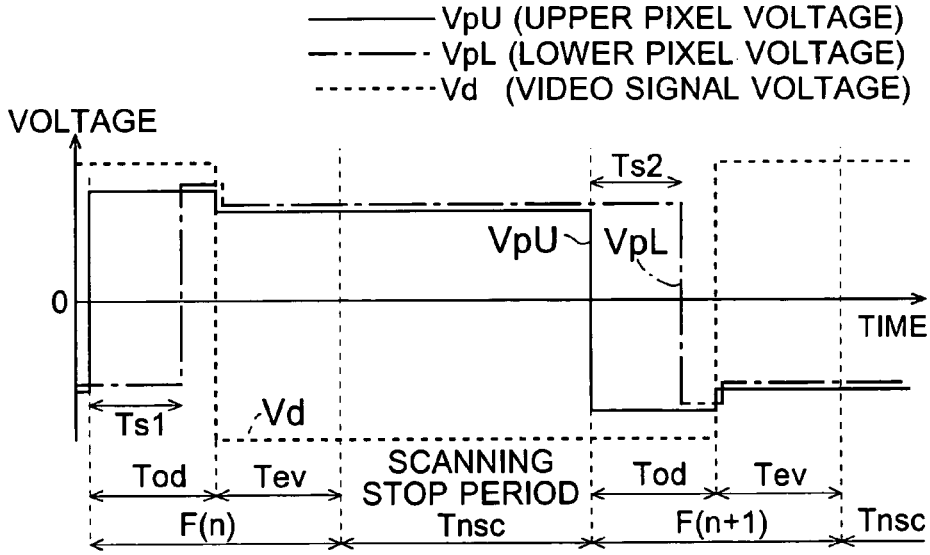
FIG. 15B shows the waveforms of the video signal voltage as well as the voltages applied to the pixel electrodes in the upper and lower screen portions (upper pixel voltage and lower pixel voltage) in the third embodiment.

FIG. 15A shows the waveforms of the video signal voltage Vd, the voltage VpU applied to the pixel electrodes in the upper screen portion (also referred simply to as "upper pixel voltage" in the following), and the voltage VpL applied to the pixel electrodes in the lower screen portion (also referred to simply as "lower pixel voltage" in the following), in the first embodiment. FIG. 15B shows the waveform of the video signal voltage Vd, the upper pixel voltage VpU and the lower pixel voltage VpL in the present embodiment. In FIGS. 15A and 15B, the video signal voltage Vd is indicated by a (bold) dotted line, the upper pixel voltage VpU is indicated by a solid line, and the lower pixel voltage VpL is indicated by a dash-dot line. It should be noted that to simplify explanations, it is assumed that the same luminance is displayed in all regions of the screen.

In the first embodiment, the polarity of the video signal voltage Vd inverts when switching from the odd field Tod to the even field Tev in the n-th frame F(n) for example, and the upper pixel voltage VpU and the lower pixel voltage VpL both decrease slightly due to the influence of this inversion via the parasitic capacitances Csd (intra-pixel) and Csd (inter-pixel), as shown in FIG. 15A. However, also after the polarity inversion, the upper pixel voltage VpU and the lower pixel voltage VpL are substantially the same within the n-th frame F(n), so that hardly any difference in luminance can be observed between the upper and the lower portion of the screen. On the other hand, when proceeding to the (n+1)th frame F(n+1), the polarity of the upper pixel voltage VpU inverts, for a predetermined period Ts2 the polarity of the upper pixel voltage VpU and the polarity of the lower pixel voltage VpL are different, and after this predetermined period Ts2, also the polarity of the lower pixel voltage VpL inverts. Then, since in the predetermined period Ts2, the lower pixel voltage VpL is influenced by the video signal voltage Vd, but the upper pixel voltage VpU is hardly influenced at all by the video signal voltage Vd, the effective values (absolute values) of the upper pixel voltage VpU and the lower pixel voltage VpL differ, and as a result, there is a luminance difference between the upper portion and the lower portion of the screen. Similarly, a luminance difference between the upper portion and the lower portion of the screen also occurs in the period Ts1 until the polarity of the lower pixel voltage VpL inverts after the start of the n-th frame F(n) and the period Ts3 until the polarity of the lower pixel voltage VpL inverts after the start of the (n+2)th frame F(n+2). Thus, the presence of these periods Ts1, Ts2 and Ts3 may lead to the problem of shadows in the first embodiment.

In the present embodiment, on the other hand, as described above, there are the periods Ts1 and Ts2, in which there is a luminance difference between the upper portion and the lower portion of the screen, but as shown in FIG. 15B, a scanning stop period Tnsc is inserted, and in this scanning stop period Tnsc, the upper pixel voltage VpU and the lower pixel voltage VpL are substantially the same, so that hardly any luminance difference between the upper portion and the lower portion of the screen can be observed. Thus, with the present embodiment, the proportion of the period in which luminance differences may occur is reduced by inserting a scanning stop period Tnsc, which is a period in which no luminance differences can be observed. Thus, shadows are reduced in comparison to the first embodiment.

3.3 Modified Example

In the above-described third embodiment, scanning stop periods Tnsc are inserted while performing the skipping scanning process always in ascending order, as in the first embodiment, but it is also possible to insert scanning stop periods Tnsc while performing direction inversion scanning in which a skipping scanning process in ascending order is alternated with a skipping scanning process in descending order, as in the second embodiment.

4. Fourth Embodiment

The following is an explanation of a liquid crystal display device according to a fourth embodiment of the present invention. In this embodiment, the overall configuration is similar to that of the first embodiment, so that identical or corresponding portions are denoted by the same reference numerals, and their further description has been omitted. On the other hand, the specific configuration of the liquid crystal panel 600 and the polarity pattern of the pixel matrix in the present embodiment differ from those in the first embodiment. The following description focuses on these aspects.

4.1 Driving Method

Figure 16A:
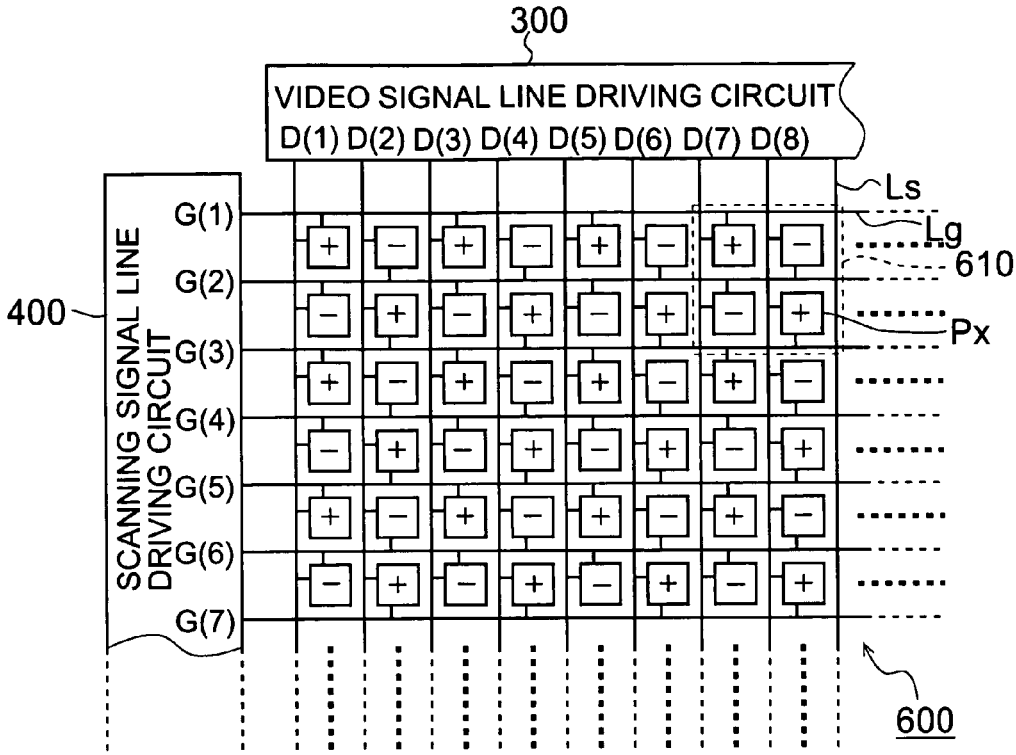
FIG. 16A is a diagram illustrating the configuration of the liquid crystal panel according to a fourth embodiment of the present invention.
Figure 16B:
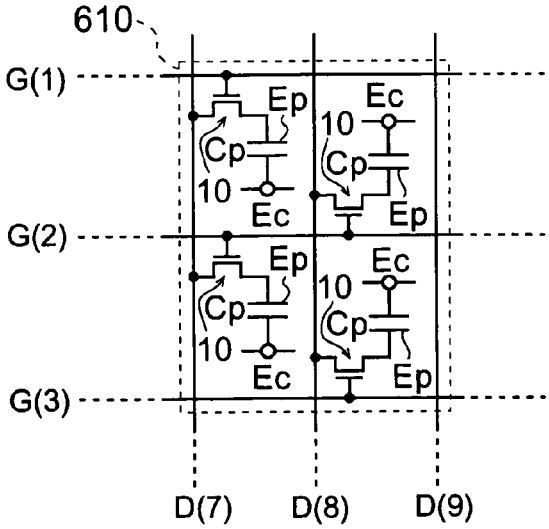
FIG. 16B is an equivalent circuit diagram of a portion (corresponding to four pixels) of this liquid crystal panel according to the fourth embodiment.

FIG. 16A is a diagram showing the configuration of the liquid crystal panel 600 in the present embodiment, and FIG. 16B is an equivalent circuit diagram of a portion 610 (corresponding to four pixels) of this liquid crystal panel 600. In these drawings, the liquid crystal panel 600 is a panel with a staggered structure. This means, pixel electrodes connected via the TFT 10 to the same scanning signal line Lg (in the following, these pixel electrodes are also referred to as "simultaneously selected pixel electrodes") are arranged not in the same row in the pixel matrix, but are distributed in a vertically staggered arrangement over two adjacent rows. That is to say, the gate terminals of the TFTs 10 that are connected to the pixel electrodes within the same row of the pixel matrix are not all connected to the same scanning signal line Lg, but are connected in a distributed arrangement to the two scanning signal lines Lg sandwiching this pixel row. It should be noted that the example of the rows shown in FIGS. 16A and 16B is a typical example, and the simultaneously selected pixel electrodes are arranged in alternation in two adjacent rows of the pixel matrix, but there is no limitation to this alternating arrangement of the simultaneously selected pixel electrodes, as long as the simultaneously selected pixel electrodes are arranged in a distributed arrangement over two adjacent rows. In the following explanations, however, it is assumed that the simultaneously selected pixel electrodes are arranged in alternation in two adjacent rows of the pixel matrix.

In the present embodiment, in accordance with the above-described distributed arrangement (staggered structure) of the simultaneously selected pixel electrodes, video signals D(j) (with j=1, 2, 3, . . . ) corresponding to the pixel values are outputted from the video signal line driving circuit 300. Therefore, the video signal driving circuit 300 may be provided with a delay circuit, in order to output the even-numbered video signals D(2), D(4), D(6), . . . with a delay of one horizontal scanning period after the odd-numbered video signals D(1), D(3), D(5), . . . . Instead of a delay circuit, it is also possible to change the configuration of the display control circuit 200 such that the pixel data of the image to be displayed are supplied to the video signal line driving circuit 300 as digital image signals Da in an order corresponding to the above-described distributed arrangement of the simultaneously selected pixel electrodes.

On the other hand, the scanning signals G(k) (with k=1, 2, 3, . . . ) and the polarities of the video signals D(j) (with j=1, 2, 3, . . . ) are as shown in FIG. 4, similar to those of the first embodiment. Also similar to the first embodiment, the common voltage Vcom has the waveform shown in FIG. 5-(*g*), so that the common electrode Ec is also AC driven.

With this configuration and driving method, the polarity pattern of the pixel matrix becomes the pattern shown in FIGS. 17A to 17F. However, in FIGS. 17A to 17F, to simplify the following explanations, the number of scanning signal lines Lg of the liquid crystal panel 600 is assumed to be six, the number of video signal lines Ls is also assumed to be six, the scanning signal line driving circuit 400 applies one of the scanning signals G(1) to G(6) to each of the six scanning signal lines Lg, and the video signal line driving circuit 300 applies one of the driving video signals D(1) to D(6) to each of the six video signal lines Ls.

Figures 17A, 17B, 17C, 17D:
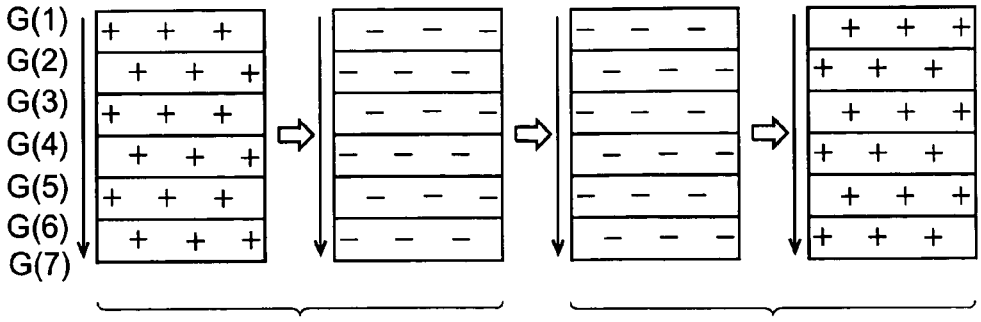
FIGS. 17A to 17F are diagrams illustrating the operation and the polarity patterns of the liquid crystal display device according to the fourth embodiment.

FIG. 17A shows the polarities of the pixel voltages corresponding to the pixel values that are overwritten by the video signals D(1) to D(6) in the odd field Tod, which is the first half-period of the n-th frame F(n). In this driving method, in the odd field Tod of this frame, the odd-numbered scanning signals G(1), G(3) and G(5) become active in this order, in other words the odd-numbered scanning lines Lg are selected in ascending order, thereby performing a first skipping scanning process, and voltages corresponding to the pixel values to be written into the pixel formation portions Px of the portions marked by "+" in the pixel matrix shown in FIG. 17A are applied to the video signal lines Ls as positive-polarity video signals D(1) to D(6). It should be noted that in the pixel matrix shown in FIG. 17A, in the pixel formation portions Px of the blank portions (i.e. the portions that are marked neither "+" nor "−") the pixel voltages applied prior to that odd field Tod are held as the pixel values (this is also the same in FIGS. 17B to 17D).

FIG. 17B shows the polarities of the pixel voltages corresponding to the pixel values that are overwritten by the video signals D(1) to D(6) in the even field, which is the second half-period of the n-th frame. In this driving method, in the even field Tev of this frame, the even-numbered scanning signals G(2), G(4) and G(6) become active in this order, in other words the even-numbered scanning lines Lg are selected in ascending order, thereby performing a second skipping scanning process, and voltages corresponding to the pixel values to be written into the pixel formation portions Px of the portions marked by "−" in the pixel matrix shown in FIG. 17B are applied to the video signal lines Ls as negative-polarity video signals D(1) to D(6).

FIG. 17C shows the polarities of the pixel voltages corresponding to the pixel values that are overwritten by the video signals D(1) to D(6) in the odd field Tod, which is the first half-period of the (n+1)th frame F(n+1). In this driving method, in the odd field Tod of this frame, the odd-numbered scanning signals G(1), G(3) and G(5) become active in this order, thereby performing a first skipping scanning process, and voltages corresponding to the pixel values to be written into the pixel formation portions Px of the portions marked by "−" in the pixel matrix shown in FIG. 17C are applied to the video signal lines Ls as negative-polarity video signals D(1) to D(6).

FIG. 17D shows the polarities of the pixel voltages corresponding to the pixel values that are overwritten by the video signals D(1) to D(6) in the even field, which is the second half-period of the (n+1)th frame. In this driving method, in the even field Tev of this frame, the even-numbered scanning signals G(2), G(4) and G(6) become active in this order, thereby performing a second skipping scanning process, and voltages corresponding to the pixel values to be written into the pixel formation portions Px of the portions marked by "+" in the pixel matrix shown in FIG. 17D are applied to the video signal lines Ls as positive-polarity video signals D(1) to D(6).

Figure 17E:
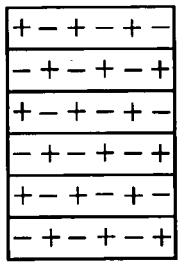
Figure 17F:
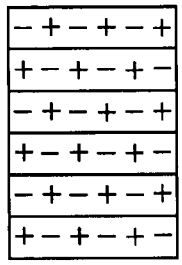

With this driving method, the polarity pattern of the pixel matrix becomes as shown in FIG. 17E at the time when the n-th frame F(n) finishes, and becomes as shown in FIG. 17F at the time when the (n+1)th frame F(n+1) finishes. Thus, with this driving method, it is possible to realize pseudo-dot inversion driving while performing line inversion driving similar to that of the first embodiment.

4.2 Advantageous Effect

Figure 18:
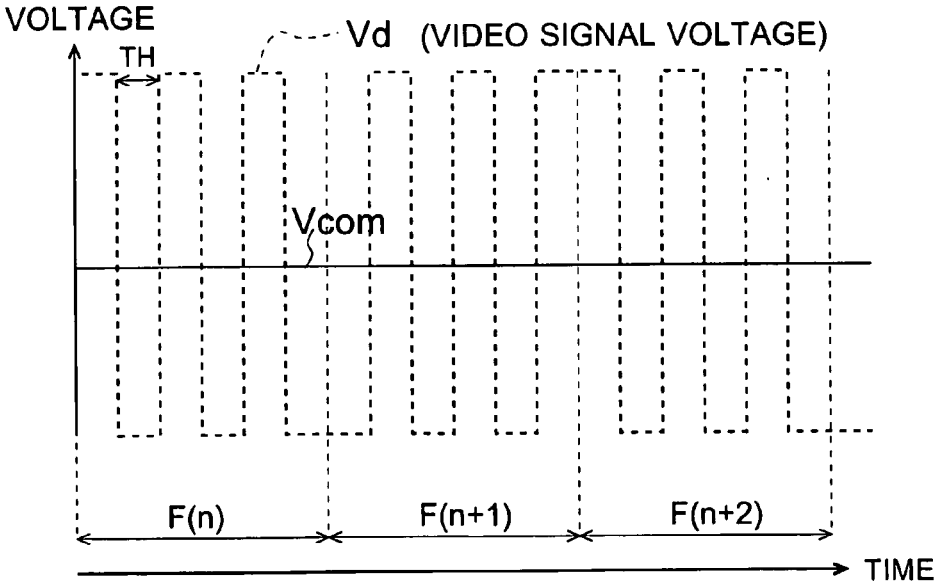
FIG. 18 is a voltage waveform diagram showing the common voltage and the video signal voltage for conventional dot inversion driving.

In the present embodiment, in addition to the effect of greatly reducing power consumption by line inversion driving as in the first embodiment, pseudo-dot inversion driving is realized as shown in FIGS. 17E and 17F, so that flicker can be reduced. Moreover, in the present embodiment, like in the first embodiment, the common voltage Vcom is an AC voltage, as shown in FIG. 5-(g), so that compared to the case of ordinary dot inversion driving, the amplitudes of the video signal voltages Vd (D(1), D(2), D(3), . . . ) are substantially reduced by half. Now, the power consumption is ordinarily proportional to the square of the voltage amplitude. Consequently, the power consumption for driving the video signal lines Ls in the present embodiment becomes approximately ¼ compared to the case that ordinary dot inversion driving with a fixed common voltage Vcom as shown in FIG. 18 is performed. That is to say, compared to a conventional liquid crystal display device employing ordinary dot inversion driving, the present embodiment achieves a further reduction in power consumption by making the common voltage Vcom an AC voltage, in addition to the considerable reduction in power consumption due to the continuous scanning of the rows to which voltage of the same polarity is to be applied in the pixel matrix within each of the frames.

4.3 Modification Example

In the fourth embodiment, basically the same scanning signals G(k) and video signals D(j) as in the first embodiment are used (see FIG. 4), but instead it is also possible to use scanning signals G(k) and video signals D(j) as in the second embodiment (see FIG. 8). Thus, since direction inversion scanning is performed, it is possible to attain the same advantageous effects as in the second embodiment (effect of shadow reduction), in addition to the advantageous effects of the fourth embodiment. Alternatively, it is also possible to use scanning signals G(k) and video signals D(j) as in the third embodiment (see FIG. 13). In this case, it is possible to attain the same advantageous effects as in the third embodiment (effect of shadow reduction and flicker reduction), by inserting a scanning stop period in addition to the advantageous effects of the fourth embodiment.

While the invention has been described in detail, the foregoing description is in all aspects illustrative and not restrictive. It is understood that numerous other modifications and variations can be devised without departing from the scope of the invention.

What is claimed is:

1. An active-matrix liquid crystal display device comprising:

a plurality of pixel formation portions for forming an image to be displayed;

a plurality of video signal lines for transmitting a plurality of video signals representing the image to the plurality of pixel formation portions;

a plurality of scanning signal lines intersecting with the plurality of video signal lines, the plurality of pixel formation portions being arranged in a matrix, in correspondence to intersections of the plurality of video signal lines and the plurality of scanning signal lines;

a scanning signal line driving circuit for selectively driving the plurality of scanning signal lines; and a video signal line driving circuit for applying the plurality of video signals to the plurality of video signal lines;

wherein each of the pixel formation portions takes in, as a pixel value, the video signal applied by the video signal line driving circuit to the video signal line passing through the corresponding intersection when the scanning signal line passing through the corresponding intersection is selected by the scanning signal line driving circuit;

wherein the scanning signal line driving circuit alternates a first skipping scanning process in which the plurality of scanning signal lines are driven by selecting, in a predetermined order, scanning signal lines that are spaced apart by one or a predetermined number of scanning signal lines, and a second skipping scanning process in which the plurality of scanning signal lines are driven by selecting, in a predetermined order, the scanning signal lines that are not selected in the first skipping scanning process; and wherein the video signal line driving circuit applies to the plurality of video signal lines voltages of like polarity in the first skipping scanning process and voltages of like polarity in the second skipping scanning process as the plurality of video signals, and inverts the polarities of the voltages that are applied to the plurality of video signal lines when the driving of the scanning signal lines by the scanning signal line driving circuit switches from the first skipping scanning process to the second skipping scanning process.

2. The active-matrix liquid crystal display device according to claim 1, wherein the scanning signal line driving circuit selectively drives the plurality of scanning signal lines such that a scanning direction based on the order in which the scanning signal lines are selected in the first skipping scanning process is opposite to a scanning direction based on the order in which the scanning signal lines are selected in the second skipping scanning process.

3. The active-matrix liquid crystal display device according to claim 1, wherein the scanning signal line driving circuit puts the plurality of scanning signal lines into an unselected state for a predetermined period after the second skipping scanning process.

4. The active-matrix liquid crystal display device according to claim 1, wherein each of the pixel formation portions comprises:

a switching element that is turned on when the scanning signal line passing through the corresponding intersection is selected, and that is turned off when the scanning signal line passing through the corresponding intersection is not selected;

a pixel electrode that is connected via the switching element to the video signal line passing through the corresponding intersection; and a common electrode that is shared by the plurality of pixel formation portions, and that is arranged such that a predetermined capacitance is formed between the common electrode and the pixel electrode;

wherein the pixel electrodes connected to the switching elements that are turned on and off by the same scanning signal line, are distributed over two vertically adjacent rows in the matrix made of the plurality of pixel formation portions.

5. A method for driving an active-matrix liquid crystal display device comprising a plurality of pixel formation portions for forming an image to be displayed; a plurality of video signal lines for transmitting a plurality of video signals representing the image to the plurality of pixel formation portions; and a plurality of scanning signal lines intersecting with the plurality of video signal lines, the plurality of pixel formation portions being arranged in a matrix, in correspondence to intersections of the plurality of video signal lines and the plurality of scanning signal lines;

the method comprising:

a scanning signal line driving step of selectively driving the plurality of scanning signal lines; and a video signal line driving step of applying the plurality of video signals to the plurality of video signal lines;

wherein, in the scanning signal line driving step, a first skipping scanning process in which the plurality of scanning signal lines are driven by selecting, in a predetermined order, scanning signal lines that are spaced apart by one or a predetermined number of scanning signal lines is performed in alternation with a second skipping scanning process in which the plurality of scanning signal lines are driven by selecting, in a predetermined order, the scanning signal lines that are not selected in the first skipping scanning process; and wherein, in the video signal line driving step, voltages of like polarity are applied to the plurality of video signal lines in the first skipping scanning process and voltages of like polarity are applied to the plurality of video signal lines in the second skipping scanning process as the plurality of video signals, and the polarities of the voltages that are applied to the plurality of video signal lines are inverted when the driving of the scanning signal lines in the scanning signal line driving step switches from the first skipping scanning process to the second skipping scanning process.

6. The driving method according to claim 5, wherein, in the scanning signal line driving step, the plurality of scanning signal lines are driven selectively such that a scanning direction based on the order in which the scanning signal lines are selected in the first skipping scanning process is opposite to a scanning direction based on the order in which the scanning signal lines are selected in the second skipping scanning process.

7. The driving method according to claim 5, wherein, in the scanning signal line driving step, the plurality of scanning signal lines are put into an unselected state for a predetermined period after the second skipping scanning process.

* * * * *